US008357029B2

(12) United States Patent
Fukushima et al.

(10) Patent No.: US 8,357,029 B2
(45) Date of Patent: Jan. 22, 2013

(54) POLISHING APPARATUS

(75) Inventors: Makoto Fukushima, Tokyo (JP); Tetsuji Togawa, Tokyo (JP); Hozumi Yasuda, Tokyo (JP); Koji Saito, Tokyo (JP); Osamu Nabeya, Tokyo (JP); Tomoshi Inoue, Tokyo (JP)

(73) Assignee: Ebara Corporation, Tokyo (JP)

( * ) Notice: Subject to any disclaimer, the term of this patent is extended or adjusted under 35 U.S.C. 154(b) by 464 days.

(21) Appl. No.: 12/747,225

(22) PCT Filed: Feb. 9, 2009

(86) PCT No.: PCT/JP2009/052456

§ 371 (c)(1),
(2), (4) Date: Jun. 10, 2010

(87) PCT Pub. No.: WO2009/102047

PCT Pub. Date: Aug. 20, 2009

(65) Prior Publication Data

US 2010/0273405 A1 Oct. 28, 2010

(30) Foreign Application Priority Data

Feb. 13, 2008 (JP) ..... 2008-031307

(51) Int. Cl.
*B24B 5/00* (2006.01)

(52) U.S. Cl. ..... 451/288; 451/285; 451/286; 451/287; 451/289; 451/398

(58) Field of Classification Search ..... 451/41, 451/285–290, 398, 449, 388
See application file for complete search history.

(56) References Cited

U.S. PATENT DOCUMENTS

| | | | | |
|---|---|---|---|---|
| 4,270,314 | A * | 6/1981 | Cesna | 451/288 |
| 5,205,082 | A * | 4/1993 | Shendon et al. | 451/41 |
| 5,584,751 | A * | 12/1996 | Kobayashi et al. | 451/288 |
| 5,681,215 | A * | 10/1997 | Sherwood et al. | 451/388 |
| 5,762,544 | A | 6/1998 | Zuniga et al. | |
| 5,795,215 | A * | 8/1998 | Guthrie et al. | 451/286 |
| 5,993,302 | A | 11/1999 | Chen et al. | |
| 6,019,868 | A * | 2/2000 | Kimura et al. | 156/345.14 |
| 6,113,468 | A * | 9/2000 | Natalicio | 451/41 |

(Continued)

FOREIGN PATENT DOCUMENTS

| | | |
|---|---|---|
| JP | 11-188618 | 7/1999 |
| JP | 2000-94309 | 4/2000 |

(Continued)

OTHER PUBLICATIONS

International Search Report issued May 26, 2009 in International (PCT) Application No. PCT/JP2009/052456.

*Primary Examiner* — George Nguyen
(74) *Attorney, Agent, or Firm* — Wenderoth, Lind & Ponack, L.L.P.

(57) ABSTRACT

A polishing apparatus is used for polishing a substrate such as a semiconductor wafer to a flat mirror finish. The polishing apparatus includes a polishing table (100) having a polishing surface (101*a*), a top ring body (2) configured to hold and press a substrate against the polishing surface (101*a*), and a retainer ring (3) provided at an outer peripheral portion of the top ring body (2) and configured to press the polishing surface (101*a*). A fulcrum for receiving a lateral force applied from the substrate to the retainer ring (3) during polishing of the substrate is located above a central portion of the substrate.

16 Claims, 19 Drawing Sheets

U.S. PATENT DOCUMENTS

| | | | | |
|---|---|---|---|---|
| 6,206,768 | B1 | 3/2001 | Quek | |
| 6,280,306 | B1 * | 8/2001 | Hosoki et al. | 451/288 |
| 6,309,290 | B1 * | 10/2001 | Wang et al. | 451/398 |
| 6,354,928 | B1 * | 3/2002 | Crevasse et al. | 451/397 |
| 6,390,904 | B1 | 5/2002 | Gleason et al. | |
| 6,409,585 | B1 * | 6/2002 | Oowada | 451/364 |
| 6,435,949 | B1 * | 8/2002 | Katsuoka et al. | 451/59 |
| 6,443,815 | B1 | 9/2002 | Williams | |
| 6,443,821 | B1 * | 9/2002 | Kimura et al. | 348/231.6 |
| 6,443,826 | B1 | 9/2002 | Yang et al. | |
| 6,506,105 | B1 * | 1/2003 | Kajiwara et al. | 451/289 |
| 6,540,592 | B1 | 4/2003 | Schultz et al. | |
| 6,558,232 | B1 | 5/2003 | Kajiwara et al. | |
| 6,565,424 | B2 | 5/2003 | Katagiri et al. | |
| 6,623,343 | B2 | 9/2003 | Kajiwara et al. | |
| 6,645,057 | B2 | 11/2003 | Quek | |
| 6,702,658 | B2 * | 3/2004 | Numoto | 451/288 |
| 6,709,322 | B2 | 3/2004 | Saldana et al. | |
| 6,796,887 | B2 | 9/2004 | Marquardt | |
| 6,843,707 | B2 | 1/2005 | Saldana et al. | |
| 6,866,567 | B2 | 3/2005 | Gotkis | |
| 8,100,743 | B2 * | 1/2012 | Nabeya et al. | 451/286 |
| 2004/0171331 | A1 * | 9/2004 | Maloney et al. | 451/41 |
| 2006/0240750 | A1 | 10/2006 | Oh et al. | |
| 2007/0197146 | A1 | 8/2007 | Oh et al. | |
| 2009/0191797 | A1 * | 7/2009 | Nabeya et al. | 451/54 |

FOREIGN PATENT DOCUMENTS

| | | |
|---|---|---|
| JP | 2001-526969 | 12/2001 |
| JP | 2005-088171 | 4/2005 |
| JP | 2006-128582 | 5/2006 |
| JP | 2006-255851 | 9/2006 |
| JP | 2007-53164 | 3/2007 |
| JP | 2007-268654 | 10/2007 |

* cited by examiner

POLISHING APPARATUS

TECHNICAL FIELD

The present invention relates generally to a polishing apparatus (planarization apparatus), and more particularly to a polishing apparatus for polishing an object to be polished (substrate) such as a semiconductor wafer to a flat mirror finish.

BACKGROUND ART

In recent years, high integration and high density in semiconductor device demands smaller and smaller wiring patterns or interconnections and also more and more interconnection layers. Multilayer interconnections in smaller circuits result in greater steps which reflect surface irregularities on lower interconnection layers. An increase in the number of interconnection layers makes film coating performance (step coverage) poor over stepped configurations of thin films. Therefore, better multilayer interconnections need to have the improved step coverage and proper surface planarization. Further, since the depth of focus of a photolithographic optical system is smaller with miniaturization of a photolithographic process, a surface of the semiconductor device needs to be planarized such that irregular steps on the surface of the semiconductor device will fall within the depth of focus.

Thus, in a manufacturing process of a semiconductor device, it increasingly becomes important to planarize a surface of the semiconductor device. One of the most important planarizing technologies is chemical mechanical polishing (CMP). Thus, there has been employed a chemical mechanical polishing apparatus for planarizing a surface of a semiconductor wafer. In the chemical mechanical polishing apparatus, while a polishing liquid containing abrasive particles such as silica ($SiO_2$) therein is supplied onto a polishing surface such as a polishing pad, a substrate such as a semiconductor wafer is brought into sliding contact with the polishing surface, so that the substrate is polished.

This type of polishing apparatus includes a polishing table having a polishing surface formed by a polishing pad, and a substrate holding device, which is referred to as a top ring or a polishing head, for holding a substrate such as a semiconductor wafer. When a semiconductor wafer is polished with such a polishing apparatus, the semiconductor wafer is held and pressed against the polishing surface under a predetermined pressure by the substrate holding device. At this time, the polishing table and the substrate holding device are moved relative to each other to bring the semiconductor wafer into sliding contact with the polishing surface in the presence of slurry solution containing a polishing powder, so that the surface of the semiconductor wafer is polished to a flat mirror finish.

In such polishing apparatus, if the relative pressing force applied between the semiconductor wafer, being polished, and the polishing surface of the polishing pad is not uniform over the entire surface of the semiconductor wafer, then the surface of the semiconductor wafer is polished insufficiently or excessively in different regions thereof depending on the pressing force applied thereto. It has been customary to uniformize the pressing force applied to the semiconductor wafer by providing a pressure chamber formed by an elastic membrane at the lower portion of the substrate holding device and supplying the pressure chamber with a fluid such as air to press the semiconductor wafer under a fluid pressure through the elastic membrane, as seen in Japanese laid-open patent publication No. 2007-268654.

In this case, the polishing pad is so elastic that pressing forces applied to a peripheral portion of the semiconductor wafer being polished become non-uniform, and hence only the peripheral portion of the semiconductor wafer may excessively be polished, which is referred to as "edge rounding". In order to prevent such edge rounding, the retainer ring for holding the peripheral edge of the semiconductor wafer is vertically movable with respect to the top ring body (or carrier head body) to press an annular portion of the polishing surface of the polishing pad that corresponds to the peripheral portion of the semiconductor wafer by the retainer ring.

In the conventional polishing apparatus such as an apparatus disclosed in the above-identified publication, a lateral force or horizontal force which works in a direction within the horizontal plane is applied to the retainer ring by a frictional force between the semiconductor wafer and the polishing surface of the polishing pad during polishing, and the lateral force (horizontal force) is received by a retainer ring guide provided at an outer circumferential side of the retainer ring.

1) Assuming the polishing apparatus has such structure, the polishing head is to have a fulcrum for receiving the lateral force (horizontal force) applied to the retainer ring by a frictional force between the semiconductor wafer and the polishing surface of the polishing pad in process of planarization of a substrate. In this apparatus, the fulcrum is to be positioned at the outer circumferential portion of the retainer ring. Because a contact area between the retainer ring and the retainer ring guide is limited (small area), in the case where the retainer ring is tilted and vertically moved to follow undulation of the polishing surface of the polishing pad, an unexpected large frictional force can be generated at sliding contact surfaces between an outer circumferential portion of the retainer ring and an inner circumferential portion of the retainer ring guide. Thus, the following capability of the retainer ring may become limited and insufficient in some cases, and there is a need for a polishing apparatus that has a capability of allowing a desired surface pressure of the retainer ring to be applied to the polishing surface of the polishing pad.

2) In the conventional polishing head in which a fulcrum of the retainer ring is positioned at the outer circumferential portion of the retainer ring and a rotary drive unit for transmitting a rotative force from the top ring (or carrier head) to the retainer ring is provided at the upper portion of the retainer ring, powder, or dried deposit generated after dry of a solution, may be generated at the fulcrum portion and the rotary drive unit due to sliding motion accompanying a frictional force. In the case where such powder falls down onto the polishing surface of a polishing table, defect such as scratch on the semiconductor wafer may be caused by the existence of the powder on the polishing surface in general. Thus, a member (boot) is an effective measure for preventing the powder from falling down. Irrespective of the merit, providing the member (boot) could have a demerit in terms of maintainability, because such boot is required to be reattached at the time of replacement of expendable articles, resulting in the possibility of tedious maintenance.

3) Because the retainer ring is thermally expanded during polishing, it is necessary to provide an adequate clearance between the retainer ring and the retainer ring guide. However, providing too wide clearance may cause an unexpected movement of the retainer ring, and abnormal noise or vibration tends to be generated at the time of collision between the retainer ring guide and the retainer ring caused by movement of the retainer ring in the clearance during polishing. Further, providing too wide clearance has another deficiency. If the retainer ring is off-centered with respect to the semiconductor wafer, variation in the polishing rate could be seen. For example, there could exist increases of the polishing rate at the outer circumferential portion of the semiconductor wafer in the circumferential direction of the semiconductor wafer.

4) Heat causes a thermal expansion of the retainer ring, and the heat is caused by friction between the retainer ring and the polishing surface. Thus, the retainer ring may spread outward toward the bottom due to a temperature difference and a linear expansion coefficient difference between the retainer ring and a drive ring to which the retainer ring is attached. If the semiconductor wafer is polished in this state, then the inner circumferential side of the retainer ring is to be worn faster than the outer circumferential side of the retainer ring, resulting in uneven wear of the retainer ring. Thus, the effect of the retainer ring for correcting the configuration of the pad surface of the polishing pad is not identical to between at the initial stage after replacement of the retainer ring, and at the stage of thereafter. Further, when a plurality of semiconductor wafers are sequentially processed, a temperature of the retainer ring gradually increases as the number of the processed semiconductor wafers increases during processing. In this case, thermal deformation quantity of the retainer ring gradually increases to cause the effect of the retainer ring to be changed between the processed semiconductor wafers. Furthermore, uneven wear of the retainer ring could occur and the effect of the retainer ring varies with time due to deformation of the retainer ring caused by a frictional force between the polishing surface and the semiconductor wafer.

DISCLOSURE OF INVENTION

There is a need for a new polishing apparatus capable of coping with these issues thereby reducing cost of fabrication process. Accordingly, there needs an invention to provide a polishing apparatus which can improve the following capability of a retainer ring against a polishing surface, the retainer ring for holding a peripheral edge of a substrate being provided at a peripheral portion of a top ring for holding the substrate, can apply a desired surface pressure of the retainer ring to the polishing surface, and can prevent powder generated at sliding contact portion of the retainer ring from falling down onto the polishing surface and suppress thermal expansion of the retainer ring.

In order to achieve the above object, according to a first aspect of the present invention, there is provided an apparatus for polishing a substrate, comprising: a polishing table having a polishing surface; a top ring body having a pressure chamber for being supplied with a pressurized fluid and configured to press the substrate against the polishing surface under a fluid pressure when the pressure chamber is supplied with the pressurized fluid; and a retainer ring provided at an outer peripheral portion of the top ring body and configured to be movable independently of the top ring body and to press the polishing surface; wherein a fulcrum for receiving a lateral force applied from the substrate to the retainer ring during polishing of the substrate is located above a central portion of the substrate.

According to the present invention, because a fulcrum for receiving a lateral force applied from the substrate to the retainer ring is located above a central portion of the substrate, that is, at a central portion of the top ring body, the area for supporting the retainer ring becomes large. Thus, when the retainer ring is tilted and vertically moved to follow undulation of the polishing surface of the polishing table, a frictional force of the sliding contact surfaces (sliding surfaces) for supporting the retainer ring slidably can be remarkably reduced, the following capability of the retainer ring against the polishing surface can be improved, and a desired surface pressure of the retainer ring can be applied to the polishing surface.

In a preferred aspect of the present invention, the retainer ring is tiltable about the fulcrum.

In a preferred aspect of the present invention, the retainer ring is vertically movably supported on an axis passing through the fulcrum.

In a preferred aspect of the present invention, the top ring body has at least one elastic membrane configured to form a plurality of pressure chambers for being supplied with a pressurized fluid; and wherein the fulcrum is located above the pressure chamber located at the central portion of the substrate.

In a preferred aspect of the present invention, the fulcrum is located at a rotation center of a support mechanism for supporting the retainer ring by the top ring body.

According to a second aspect of the present invention, there is provided an apparatus for polishing a substrate, comprising: a polishing table having a polishing surface; a top ring body having a pressure chamber for being supplied with a pressurized fluid and configured to press the substrate against the polishing surface under a fluid pressure when the pressure chamber is supplied with the pressurized fluid; and a retainer ring provided at an outer peripheral portion of the top ring body and configured to be movable independently of the top ring body and to press the polishing surface; wherein a support mechanism for supporting the retainer ring tiltably to allow the retainer ring to follow movement of the polishing surface is located above a central portion of the substrate.

According to the present invention, because a support mechanism for supporting the retainer ring tiltably is located above a central portion of the substrate, that is, at a central portion of the top ring body, the supporting area (sliding area) of the support mechanism becomes large. Thus, when the retainer ring is tilted to follow undulation of the polishing surface of the polishing table, a frictional force of the sliding portion for supporting the retainer ring slidably can be remarkably reduced, the following capability of the retainer ring against the polishing surface can be improved, and a desired surface pressure of the retainer ring can be applied to the polishing surface.

In a preferred aspect of the present invention, the support mechanism supports the retainer ring vertically movably.

In a preferred aspect of the present invention, the retainer ring is movable independently of the top ring body by the support mechanism.

According to the present invention, because the retainer ring is tiltable independently of the top ring body which holds the elastic membrane, the top ring body, particularly the member holding the elastic membrane can maintain an initial posture or form, irrespective of a frictional force between the substrate and the polishing surface of the polishing table. Thus, the substrate can be uniformly pressed against the polishing surface.

In a preferred aspect of the present invention, sliding contact surfaces of the support mechanism is composed of a low friction material.

According to the present invention, because sliding contact surfaces of the support mechanism is composed of a low friction material, when the retainer ring is tilted and vertically moved to follow undulation of the polishing surface of the polishing table, a frictional force of the sliding contact surfaces (sliding surfaces) of the support mechanism for supporting the retainer ring can be remarkably reduced, the following capability of the retainer ring against the polishing surface can be improved, and a desired surface pressure of the retainer ring can be applied to the polishing surface.

The low friction material is defined as a material having a low coefficient of friction of 0.35 or less. It is desirable that the low friction material has a coefficient of friction of 0.25 or less. The coefficient of friction is dimensionless value under conditions of no lubricating oil. Further, it is desirable that the low friction material comprises a sliding material having high wear resistance. The low friction material comprises oil-containing polyacetal, for example.

In a preferred aspect of the present invention, the retainer ring comprises a ring member configured to hold an peripheral edge of the substrate, a holding portion disposed at a central portion of the top ring body and configured to hold the ring member, and a connecting portion for connecting the ring member and the holding portion; and wherein the holding portion is supported by the support mechanism.

In a preferred aspect of the present invention, the top ring body has at least one elastic membrane configured to form a plurality of pressure chambers for being supplied with a pressurized fluid; and wherein the support mechanism is located above the pressure chamber located at the central portion of the substrate.

In a preferred aspect of the present invention, the support mechanism comprises a spherical bearing mechanism for supporting the retainer ring rotatably by a spherical surface.

In a preferred aspect of the present invention, the support mechanism comprises a gyro mechanism for supporting the retainer ring rotatably about two orthogonal axes.

In a preferred aspect of the present invention, a metal ring is mounted on the retainer ring.

According to the present invention, since a metal ring made of SUS or the like is fitted over the retainer ring, the retainer ring has an improved rigidity. Thus, even if a temperature of the retainer ring increases due to the sliding contact between the retainer ring and the polishing surface, thermal deformation of the retainer ring can be suppressed.

In a preferred aspect of the present invention, the apparatus further comprises a nozzle configured to supply a fluid for cooling the retainer ring.

According to the present invention, although the temperature of the retainer ring increases by friction heat between the retainer ring and the polishing surface, a cooling fluid is blown onto the outer circumferential surface of the retainer ring, and hence the temperature of the retainer ring can be prevented from increasing to suppress thermal expansion of the retainer ring.

In a preferred aspect of the present invention, the apparatus further comprises a rotary drive unit provided in the top ring body and configured to transmit a rotative force from the top ring body to the retainer ring.

According to the present invention, because a rotary drive unit for transmitting a rotative force from the top ring body to the retainer ring is provided in the top ring body, powder generated from the rotary drive unit can be contained within the top ring body and hardly falls down onto the polishing surface, and defect such as scratch on the substrate caused by powder can be remarkably reduced.

The present invention has the following advantages.

(1) When the retainer ring is tilted to follow undulation of the polishing surface of the polishing pad, a frictional force of the sliding portion for supporting the retainer ring slidably can be remarkably reduced, the following capability of the retainer ring against the polishing surface can be improved, and a desired surface pressure of the retainer ring can be applied to the polishing surface.

(2) Since the portion for supporting the retainer ring slidably is provided in the top ring body, powder generated at the sliding portion can be contained within the top ring body and hardly falls down onto the polishing surface, and defect such as scratch on the substrate caused by powder can be remarkably reduced.

(3) If the retainer ring is supported by a retainer ring guide provided at an outer circumferential portion of the retainer ring, there is too wide clearance between the retainer ring and the retainer ring guide. In this case, abnormal noise or vibration tends to be generated at the time of collision between the retainer ring guide and the retainer ring caused by movement of the retainer ring in the clearance during polishing, and variation in the polishing rate occurs at the outer circumferential portion of the semiconductor wafer in the circumferential direction of the semiconductor wafer.

According to the prevent invention, because the retainer ring is supported by the central portion of the top ring body, it is not necessary to provide a retainer ring guide at the outer circumferential side of the retainer ring so as to support a retainer ring. Thus, abnormal noise or vibration generated by movement of the retainer ring in the clearance during polishing can be prevented, and variation in the polishing rate at the outer circumferential portion of the substrate in the circumferential direction of the substrate can be prevented.

(4) Since a metal ring made of SUS or the like is fitted over the retainer ring, the retainer ring has an improved rigidity. Thus, even if a temperature of the retainer ring increases due to the sliding contact between the retainer ring and the polishing surface, thermal deformation of the retainer ring can be suppressed. Further, the retainer ring can be cooled by supplying a cooling fluid to the retainer ring. Therefore, the temperature of the retainer ring can be prevented from increasing, resulting in suppressing thermal expansion of the retainer ring. Thus, the effect of the retainer ring for correcting the configuration of the polishing surface comprising a polishing pad does not vary with time.

The above and other objects, features, and advantages of the present invention will become apparent from the following description when taken in conjunction with the accompanying drawings which illustrate preferred embodiments of the present invention by way of example.

BEST MODE FOR CARRYING OUT THE INVENTION

Figure 1:
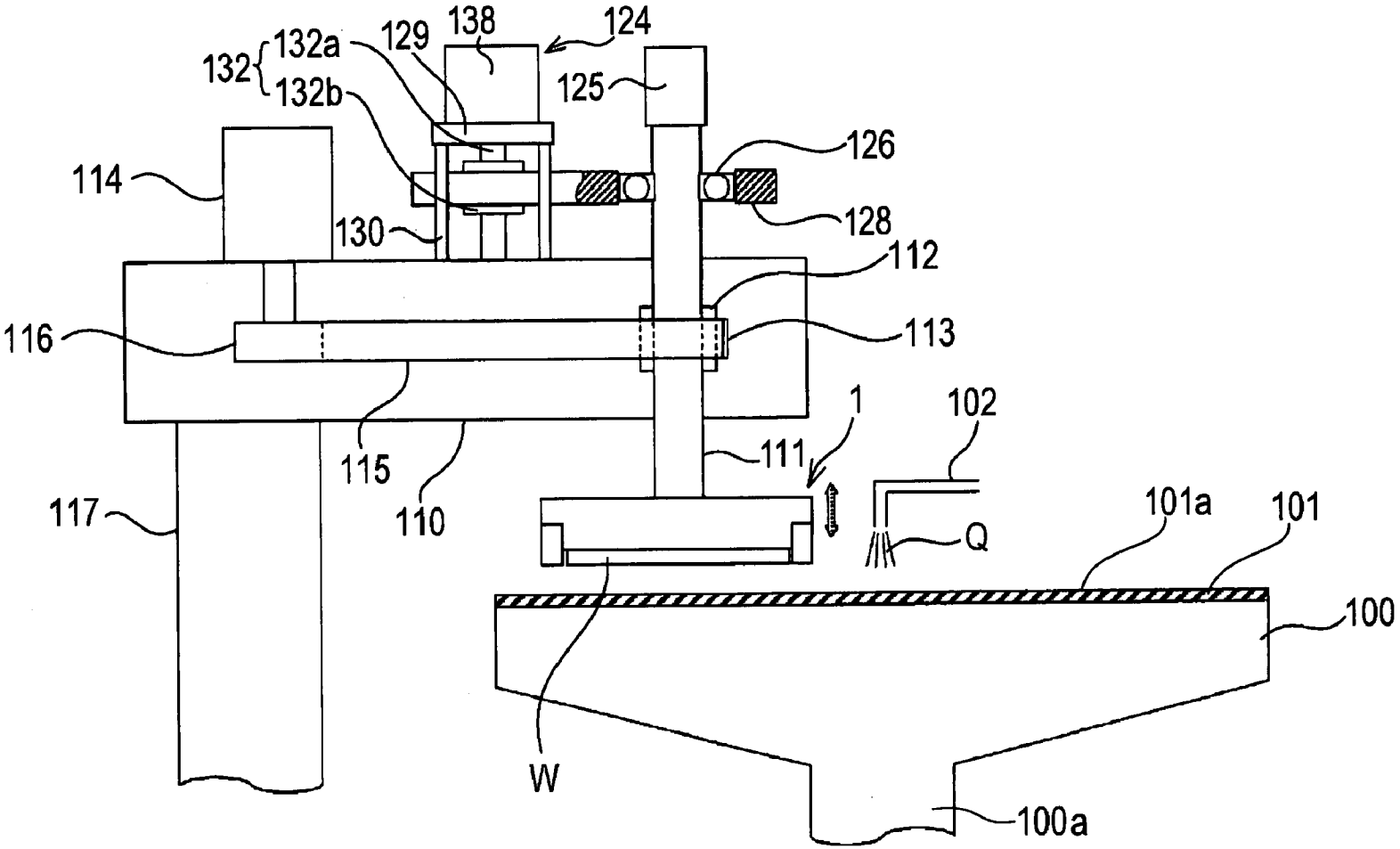
FIG. 1 is a schematic view showing an entire structure of a polishing apparatus according to an embodiment of the present invention.

A polishing apparatus according to embodiments of the present invention will be described below with reference to FIGS. 1 through 19. Like or corresponding parts are denoted by like or corresponding reference numerals throughout drawings and will not be described below repetitively.

FIG. 1 is a schematic view showing an entire structure of the polishing apparatus according to an embodiment of the present invention. As shown in FIG. 1, the polishing apparatus comprises a polishing table 100, and a top ring 1 constituting a polishing head for holding a substrate such as a semiconductor wafer as an object to be polished and pressing the substrate against a polishing surface on the polishing table 100.

The polishing table 100 is coupled via a table shaft 100*a* to a motor (not shown) disposed below the polishing table 100. Thus, the polishing table 100 is rotatable about the table shaft 100*a*. A polishing pad 101 is attached to an upper surface of the polishing table 100. An upper surface 101*a* of the polishing pad 101 constitutes a polishing surface to polish a semiconductor wafer W. A polishing liquid supply nozzle 102 is provided above the polishing table 100 to supply a polishing liquid Q onto the polishing pad 101 on the polishing table 100.

The top ring 1 is connected to a lower end of a top ring shaft 111, which is vertically movable with respect to a top ring head 110 by a vertically moving mechanism 124. When the vertically moving mechanism 124 moves the top ring shaft 111 vertically, the top ring 1 is lifted and lowered as a whole for positioning with respect to the top ring head 110. A rotary joint 125 is mounted on the upper end of the top ring shaft 111.

The vertically moving mechanism 124 for vertically moving the top ring shaft 111 and the top ring 1 comprises a bridge 128 on which the top ring shaft 111 is rotatably supported by a bearing 126, a ball screw 132 mounted on the bridge 128, a support base 129 supported by support posts 130, and an AC servomotor 138 mounted on the support base 129. The support base 129, which supports the AC servomotor 138 thereon, is fixedly mounted on the top ring head 110 by the support posts 130.

The ball screw 132 comprises a screw shaft 132*a* coupled to the AC servomotor 138 and a nut 132*b* threaded over the screw shaft 132*a*. The top ring shaft 111 is vertically movable in unison with the bridge 128 by the vertically moving mechanism 124. When the AC servomotor 138 is energized, the bridge 128 moves vertically via the ball screw 132, and the top ring shaft 111 and the top ring 1 move vertically.

The top ring shaft 111 is connected to a rotary sleeve 112 by a key (not shown). The rotary sleeve 112 has a timing pulley 113 fixedly disposed therearound. A top ring motor 114 having a drive shaft is fixed to the top ring head 110. The timing pulley 113 is operatively coupled to a timing pulley 116 mounted on the drive shaft of the top ring motor 114 by a timing belt 115. When the top ring motor 114 is energized, the timing pulley 116, the timing belt 115, and the timing pulley 113 are rotated to rotate the rotary sleeve 112 and the top ring shaft 111 in unison with each other, thus rotating the top ring 1. The top ring head 110 is supported on a top ring head shaft 117 fixedly supported on a frame (not shown).

In the polishing apparatus constructed as shown in FIG. 1, the top ring 1 is configured to hold the substrate such as a semiconductor wafer W on its lower surface. The top ring head 110 is pivotable (swingable) about the top ring head shaft 117. Thus, the top ring 1, which holds the semiconductor wafer W on its lower surface, is moved between a position at which the top ring 1 receives the semiconductor wafer W and a position above the polishing table 100 by pivotal movement of the top ring head 110. The top ring 1 is lowered to press the semiconductor wafer W against a surface (polishing surface) 101*a* of the polishing pad 101. At this time, while the top ring 1 and the polishing table 100 are respectively rotated, a polishing liquid is supplied onto the polishing pad 101 by the polishing liquid supply nozzle 102 provided above the polishing table 100. The semiconductor wafer W is brought into sliding contact with the polishing surface 101*a* of the polishing pad 101. Thus, a surface of the semiconductor wafer W is polished.

Next, a polishing head of a polishing apparatus according to a first aspect of the present invention will be described below with reference to FIGS. 2 through 5. FIGS. 2 through 5 show a top ring 1 constituting a polishing head for holding a semiconductor wafer W as an object to be polished and pressing the semiconductor wafer W against a polishing surface on a polishing table. FIGS. 2 through 5 are cross-sectional views taken along a plurality of the radial directions of the top ring 1.

As shown in FIGS. 2 through 5, the top ring 1 basically comprises a top ring body 2 for pressing a semiconductor wafer W against the polishing surface 101*a*, and a retainer ring 3 for directly pressing the polishing surface 101*a* independently of the top ring body 2. The top ring body 2 includes an upper member 300 in the form of a circular plate, an intermediate member 304 attached to a lower surface of the upper member 300, and a lower member 306 attached to a lower surface of the intermediate member 304.

The top ring 1 has an elastic membrane 314 attached to a lower surface of the lower member 306. The elastic membrane 314 is brought into contact with a rear face of a semiconductor wafer held by the top ring 1. The elastic membrane 314 is held on the lower surface of the lower member 306 by an annular edge holder 316 disposed radially outward and annular ripple holders 318 and 319 disposed radially inward of the edge holder 316. The elastic membrane 314 is made of a highly strong and durable rubber material such as ethylene propylene rubber (EPDM), polyurethane rubber, silicone rubber, or the like.

Figure 2:
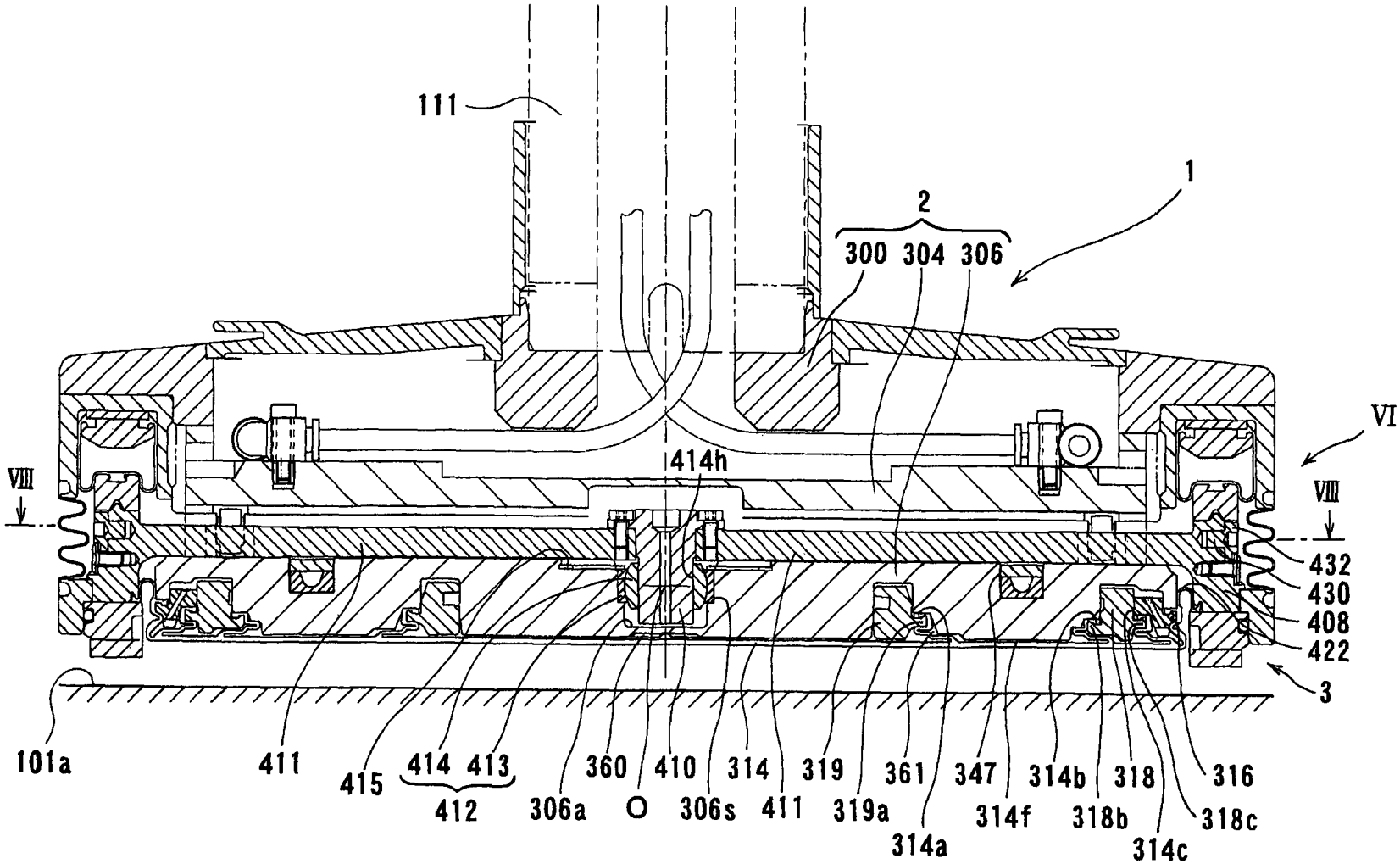
FIG. 2 is a cross-sectional view showing a top ring constituting a polishing head according to a first aspect of the present invention.

As shown in FIG. 2, the retainer ring 3 comprises a ring member 408 disposed at an outer peripheral portion of the top ring body 2 and configured to hold a peripheral edge of the semiconductor wafer, a shaft-like holding portion 410 disposed at a radially central portion of the top ring body 2 and configured to hold the ring member 408, and connecting portions 411 for connecting the ring member 408 and the shaft-like holding portion 410.

Figure 3:
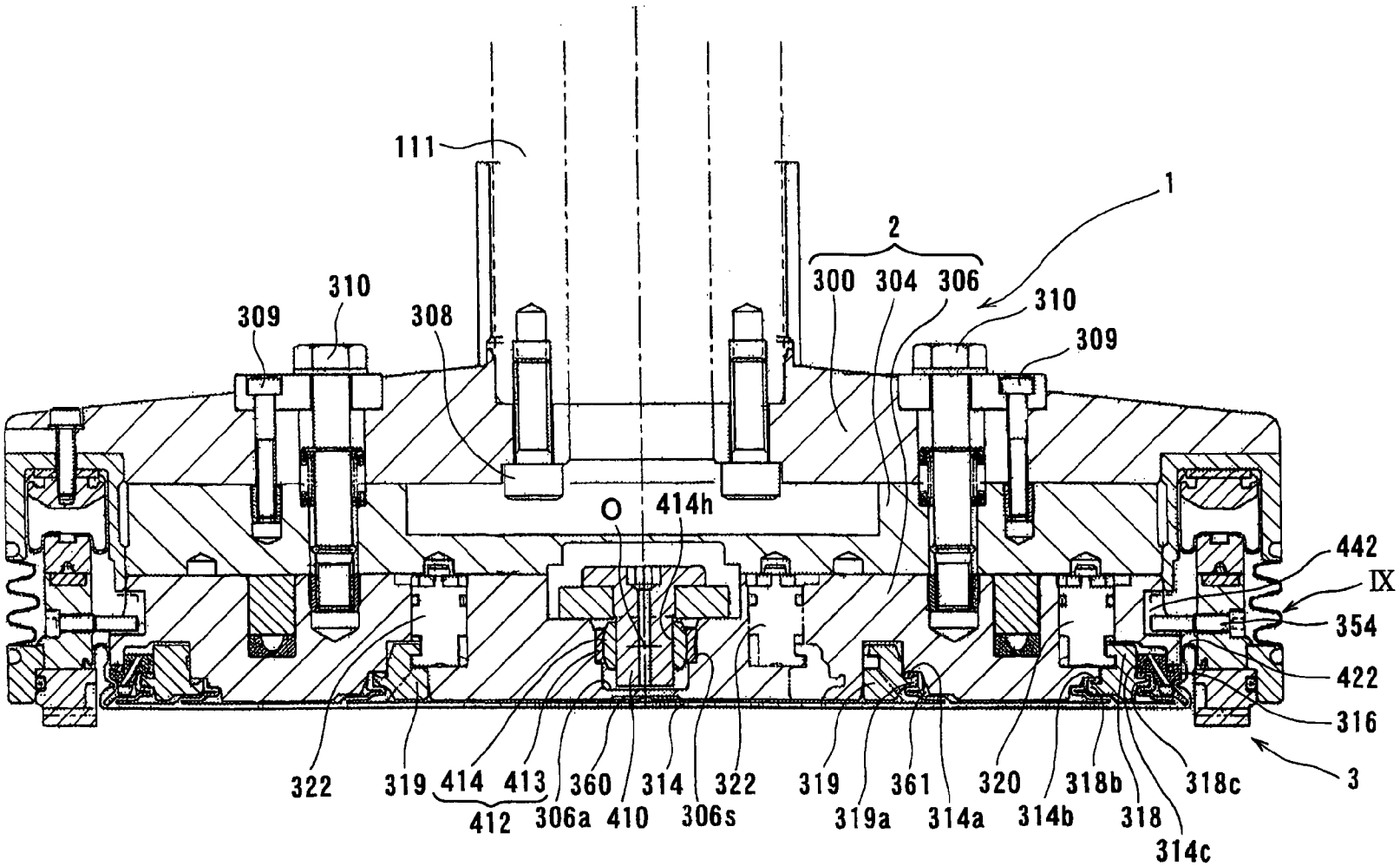
FIG. 3 is a cross-sectional view showing the top ring shown in FIG. 1.

As shown in FIG. 3, the upper member 300 is connected to the top ring shaft 111 by bolts 308. Further, the intermediate member 304 is fixed to the upper member 300 by bolts 309, and the lower member 306 is fixed to the upper member 300 by main bolts 310. The top ring body 2 comprising the upper member 300, the intermediate member 304, and the lower member 306 is made of resin such as engineering plastics (e.g., PEEK). The upper member 300 may be composed of a metal such as SUS or aluminum.

As shown in FIG. 2, the shaft-like holding portion 410 of the retainer ring 3 is supported by the lower member 306 through a support mechanism 412. In the present embodiment, the support mechanism 412 comprises a spherical bearing mechanism having an outer ring 413 fitted in a recess 306*a* of the lower member 306 and fixed to the lower member 306, and an inner ring 414 supported by the outer ring 413. The inner circumferential surface of the outer ring 413 and the outer circumferential surface of the inner ring 414 are formed into spherical surfaces whose center is a fulcrum O, and are brought into sliding contact with each other.

The inner ring 414 is rotatable (tiltable) in all directions (360°) about the fulcrum O with respect to the outer ring 413. That is, the fulcrum O is located at the center of rotation of the inner ring 414 and the fulcrum O is also located above the central portion of the semiconductor wafer while polishing the semiconductor wafer. The shaft-like holding portion 410 of the retainer ring 3 is vertically movably fitted in a circular through-hole 414*h* of the inner ring 414. The outer ring 413 is fixed to the lower member 306 in such a manner that the lower end of the outer ring 413 is brought into contact with a step 306*s* of the recess 306*a* of the lower member 306 and the upper end of the outer ring 413 is engaged with a plurality of C-type snap rings 415.

In the retainer ring 3 constructed as shown in FIG. 2, the retainer ring 3 is brought into contact with the polishing surface 101*a* of the polishing table 100 during polishing, and is tiltable with respect to the horizontal plane independently of the top ring body 2 to follow undulation of the polishing surface 101*a* of the polishing table 100. Specifically, the ring member 408 is tilted with respect to the horizontal plane to follow movement of the polishing surface 101*a*, and the shaft-like holding portion 410 is tilted integrally with the ring member 408. The tilting of the ring member 408 and the shaft-like holding portion 410 is allowed by the support mechanism 412 comprising a spherical bearing mechanism. In other words, the ring member 408 and the shaft-like holding portion 410 are tiltable by rotation of the inner ring 414 about the fulcrum O in all directions. Specifically, the retainer ring 3 including the ring member 408 is tiltable (rotatable) about the fulcrum O located at the central portion of the top ring body 2 by the support mechanism 412 comprising a spherical bearing mechanism. Further, the retainer ring 3 is vertically movable to follow undulation of the polishing surface 101*a* of the polishing table 100, simultaneously with the tilting motion. That is, the ring member 408 is vertically moved to follow undulation of the polishing surface 101*a*, and the shaft-like holding portion 410 is vertically moved integrally with the ring member 408. The vertical motion of the shaft-like holding portion 410 is guided by the through-hole 414*h* of the inner ring 414. A lateral force (horizontal force) is applied to the retainer ring 3 by a frictional force between the semiconductor wafer and the polishing surface 101*a* of the polishing table 100 during polishing, and this lateral force can be received by the fulcrum O located above the central portion of the semiconductor wafer.

According to the support mechanism 412 for supporting the retainer ring 3 constructed as shown in FIG. 2, when the retainer ring 3 is tilted, the retainer ring 3 is smoothly tilted by the support mechanism 412. Since at least one of sliding contact surfaces of the outer ring 413 and the inner ring 414 in the support mechanism 412 is provided with a film containing Teflon (registered trademark) or the like and having a high-self-lubricating, a low coefficient of friction and a high wear resistance, the support mechanism 412 can maintain good sliding characteristics to allow the retainer ring 3 to tilt quickly. Further, one of sliding contact surfaces of the shaft-like holding portion 410 and the through-hole 414*h* of the inner ring 414 is provided with a low friction material composed of a resin material comprising polytetrafluoroethylene (PTFE), PEEK (polyetheretherketone)•PPS (polyphenylene sulfide) or the like. Accordingly, a frictional force of the sliding contact surfaces (sliding surfaces) can be remarkably reduced when the holding portion 410 of the retainer ring 3 is vertically moved with respect to the inner ring 414 of the support mechanism 412. At least one of the outer ring 413 and the inner ring 415 may comprise a resin material to which fiber such as carbon fiber and solid lubricant are added. The holding portion 410 is composed of ceramics such as SiC.

As described above, because the retainer ring 3 is supported by the central portion of the top ring body 2 through the support mechanism 412 comprising a spherical bearing mechanism, when the retainer ring 3 is tilted and vertically moved to follow undulation of the polishing surface 101*a* of the polishing table 100, the tilting motion of the retainer ring 3 can be supported by the support mechanism 412 having a spherical sliding surface whose area is large, and the vertical motion of the retainer ring 3 can be supported by the support mechanism 412 having a shaft-like sliding surface whose sliding characteristics is excellent. Therefore, a frictional force of the sliding surfaces can be remarkable reduced, the following capability of the retainer ring against the polishing surface can be improved, and a desired surface pressure of the retainer ring can be applied to the polishing surface.

Further, in the present embodiment, the retainer ring 3 is tiltable independently of the top ring body 2. In this case, if the retainer ring 3 and the top ring body 2 are integrally tiltable, the retainer ring 3 and the top ring body 2 are integrally tilted by a frictional force between the semiconductor wafer and the polishing surface of the polishing pad. When the top ring body 2 is tilted, an elastic membrane (elastic membrane 314 in the present embodiment) for holding the semiconductor wafer stretches nonuniformly within the surface of the semiconductor wafer, and a pressing force for pressing the semiconductor wafer against the polishing surface becomes nonuniform.

In contrast, according to the present embodiment, because the retainer ring 3 is tiltable independently of the top ring body 2 which holds the elastic membrane 314, the top ring body 2, particularly the lower member 306 holding the elastic membrane 314 can maintain an initial posture, irrespective of a frictional force between the semiconductor wafer and the polishing surface of the polishing pad. Thus, the semiconductor wafer can be uniformly pressed against the polishing surface.

Further, in the present embodiment, since the support mechanism 412 for supporting the retainer ring 3 tiltably and vertically movably is provided at the central portion of the top ring body 2, and is housed in the recess 306*a* of the lower member 306 of the top ring body 2, powder generated at the sliding portion of the support mechanism 412 can be contained within the top ring body 2, and hardly falls down onto the polishing surface, thereby preventing defect of the wafer due to falling down of foreign matter such as powder onto the polishing surface.

Further, in the present embodiment, because the support mechanism 412 is configured to be a low positional fulcrum, a moment for tilting the retainer ring 3 becomes smaller. Accordingly, the tilting of the retainer ring caused by a frictional force can be suppressed to a small degree, and the semiconductor wafer hardly slips off the top ring 1.

The top ring 1 will be further described. As shown in FIG. 2, the edge holder 316 is held by the ripple holder 318. As shown in FIG. 3, the ripple holder 318 is held on the lower surface of the lower member 306 by a plurality of stoppers 320. The ripple holder 319 is held on the lower surface of the lower member 306 by a plurality of stoppers 322. The stoppers 320 and the stoppers 322 are arranged along a circumferential direction of the top ring 1 at equal intervals.

Figure 4:
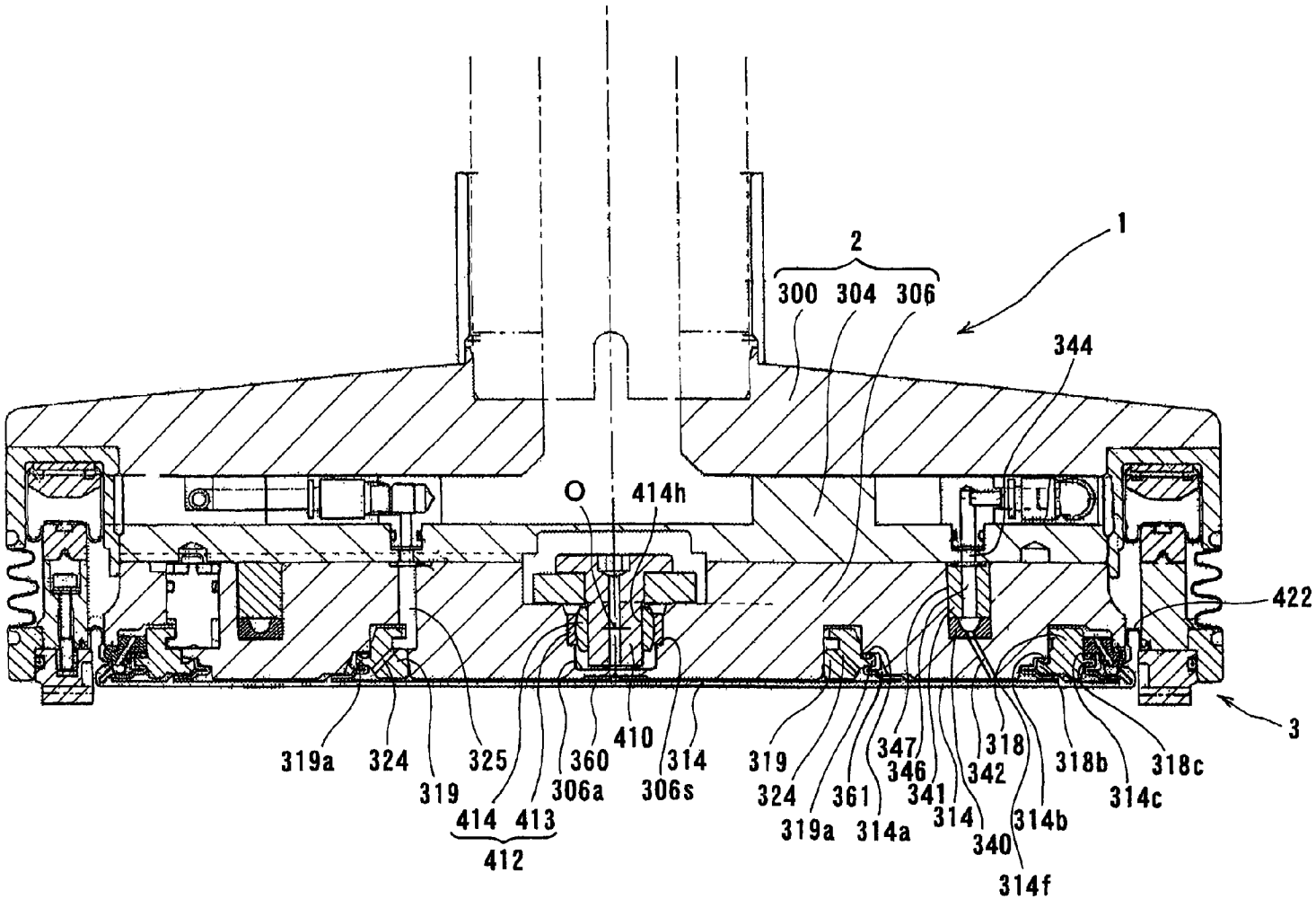
FIG. 4 is a cross-sectional view showing the top ring shown in FIG. 1.

As shown in FIG. 2, a central chamber 360 is formed at a central portion of the elastic membrane 314. As shown in FIG. 4, the ripple holder 319 has a passage 324 communicating with the central chamber 360. The lower member 306 has a passage 325 communicating with the passage 324. The passage 324 of the ripple holder 319 and the passage 325 of the lower member 306 are connected to a fluid supply source (not shown). Thus, a pressurized fluid is supplied through the passages 325 and 324 to the central chamber 360 formed by the elastic membrane 314.

The ripple holder 318 has a claw 318*b* for pressing a ripple 314*b* of the elastic membrane 314 against the lower surface of the lower member 306. The ripple holder 319 has a claw 319*a* for pressing a ripple 314*a* of the elastic membrane 314 against the lower surface of the lower member 306. The ripple holder 318 has a claw 318*c* for pressing an edge 314*c* of the elastic membrane 314 against the edge holder 316.

As shown in FIG. 4, an annular ripple chamber 361 is formed between the ripple 314*a* and the ripple 314*b* of the elastic membrane 314. A gap 314*f* is formed between the ripple holder 318 and the ripple holder 319 of the elastic membrane 314. The lower member 306 has a passage 342 communicating with the gap 314*f*. An annular groove 347 is formed in the lower member 306, a seal member 340 is provided at the lower surface of the annular groove 347, and a seal ring 341 is provided on the seal member 340. The upper surface of the seal ring 341 is pressed against the lower surface of the intermediate member 304. The seal ring 341 has a passage 346 communicating with the passage 342 of the lower member 306. Further, the intermediate member 304 has a passage 344 communicating with the passage 346 of the seal ring 341. The passage 342 of the lower member 306 is connected via the passage 346 of the seal ring 341 and the passage 344 of the intermediate member 304 to a fluid supply source (not shown). Thus, a pressurized fluid is supplied through these passages to the ripple chamber 361. Further, the passage 342 is selectively connected to a vacuum pump (not shown). When the vacuum pump is operated, a semiconductor wafer is attracted to the lower surface of the elastic membrane 314 by suction, thereby chucking the semiconductor wafer.

Figure 5:
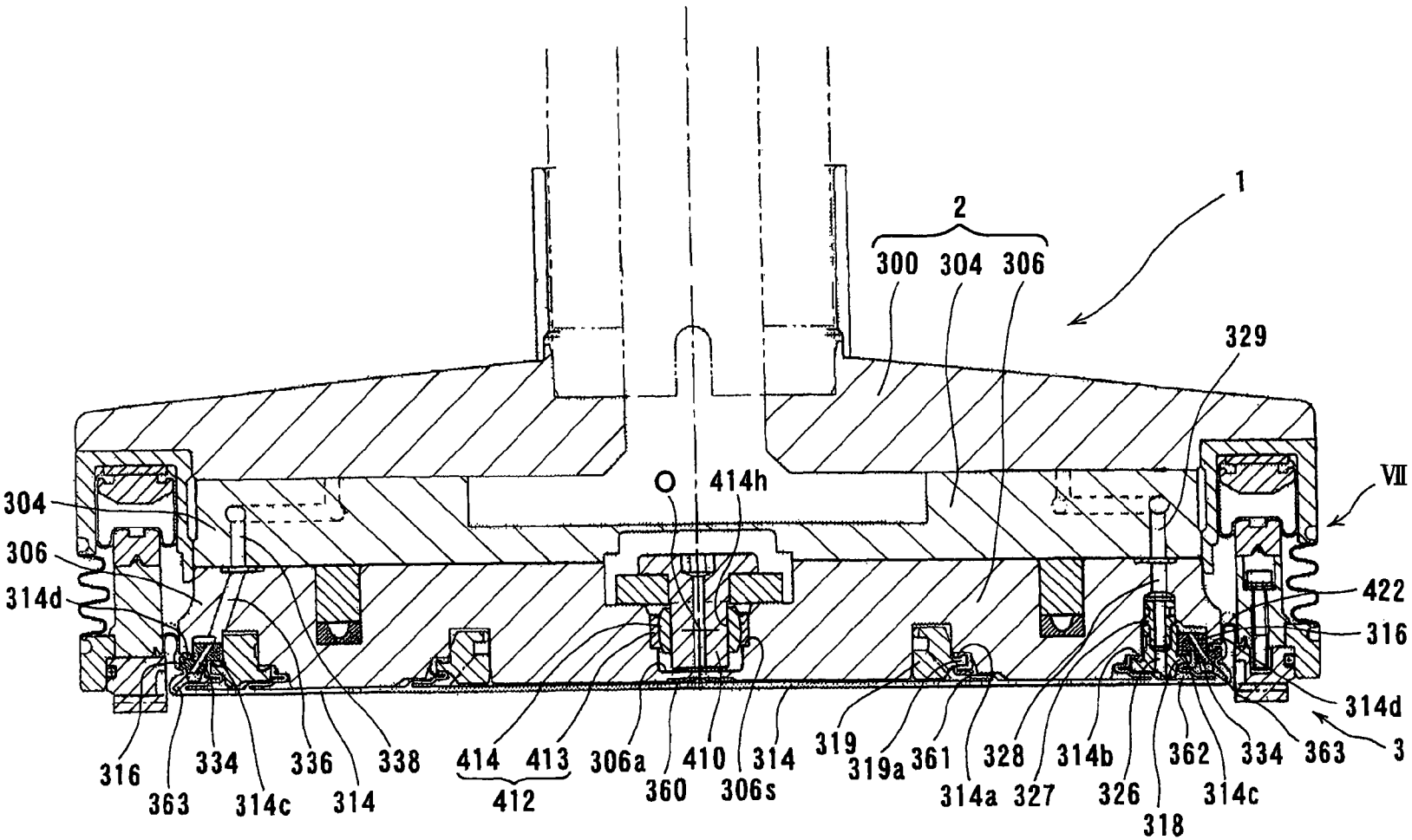
FIG. 5 is a cross-sectional view showing the top ring shown in FIG. 1.

As shown in FIG. 5, the ripple holder 318 has a passage 326 communicating with an annular outer chamber 362 formed by the ripple 314*b* and the edge 314*c* of the elastic membrane 314. Further, the lower member 306 has a passage 328 communicating with the passage 326 of the ripple holder 318 via a connector 327. The intermediate member 304 has a passage 329 communicating with the passage 328 of the lower member 306. The passage 326 of the ripple holder 318 is connected via the passage 328 of the lower member 306 and the passage 329 of the intermediate member 304 to a fluid supply source (not shown). Thus, a pressurized fluid is supplied through these passages to the outer chamber 362 formed by the elastic membrane 314.

As shown in FIG. 5, the edge holder 316 has a claw for holding an edge 314*d* of the elastic membrane 314 on the lower surface of the lower member 306. The edge holder 316 has a passage 334 communicating with an annular edge chamber 363 formed by the edges 314*c* and 314*d* of the elastic membrane 314. The lower member 306 has a passage 336 communicating with the passage 334 of the edge holder 316. The intermediate member 304 has a passage 338 communicating with the passage 336 of the lower member 306. The passage 334 of the edge holder 316 is connected via the passage 336 of the lower member 306 and the passage 338 of the intermediate member 304 to a fluid supply source (not shown). Thus, a pressurized fluid is supplied through these passages to the edge chamber 363 formed by the elastic membrane 314.

As described above, in the top ring 1 according to the present embodiment, pressing forces for pressing a semiconductor wafer against the polishing pad 101 can be adjusted at local areas of the semiconductor wafer by adjusting pressures of fluid to be supplied to the respective pressure chambers formed between the elastic membrane 314 and the lower member 306 (i.e., the central chamber 360, the ripple chamber 361, the outer chamber 362, and the edge chamber 363).

Figure 6:
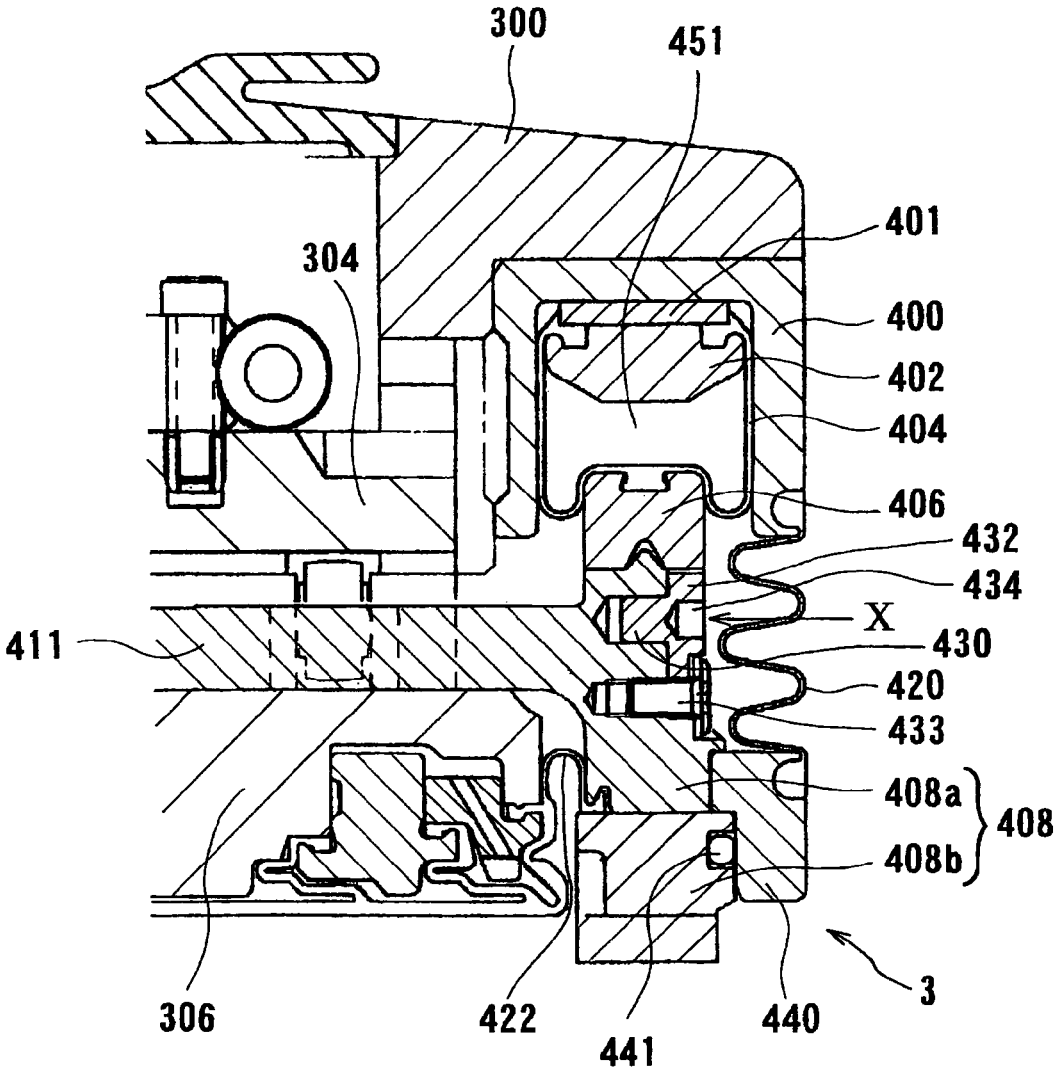
FIG. 6 is an enlarged view of VI part of FIG. 2.

FIG. 6 is an enlarged view of VI part of FIG. 2. As described above, the retainer ring 3 comprises a ring member 408 disposed at a peripheral portion of the top ring body 2 and configured to hold a peripheral edge of the semiconductor wafer, a shaft-like holding portion 410 disposed at a radially central portion of the top ring body 2 and configured to hold the ring member 408, and connecting portions 411 for connecting the ring member 408 and the shaft-like holding portion 410. As shown in FIG. 6, a retainer-ring pressing mechanism comprises a cylinder 400 having a cylindrical shape with a closed upper end, holders 401, 402 attached to an upper portion of the cylinder 400, an elastic membrane 404 held in the cylinder 400 by the holders 401, 402, and a piston 406 connected to a lower end of the elastic membrane 404. The ring member 408 is configured to be pressed downward by the piston 406. The ring member 408 comprises an upper ring member 408*a* coupled to the piston 406, and a lower ring member 408*b* which is brought into contact with the polishing surface 101.

Figure 7:
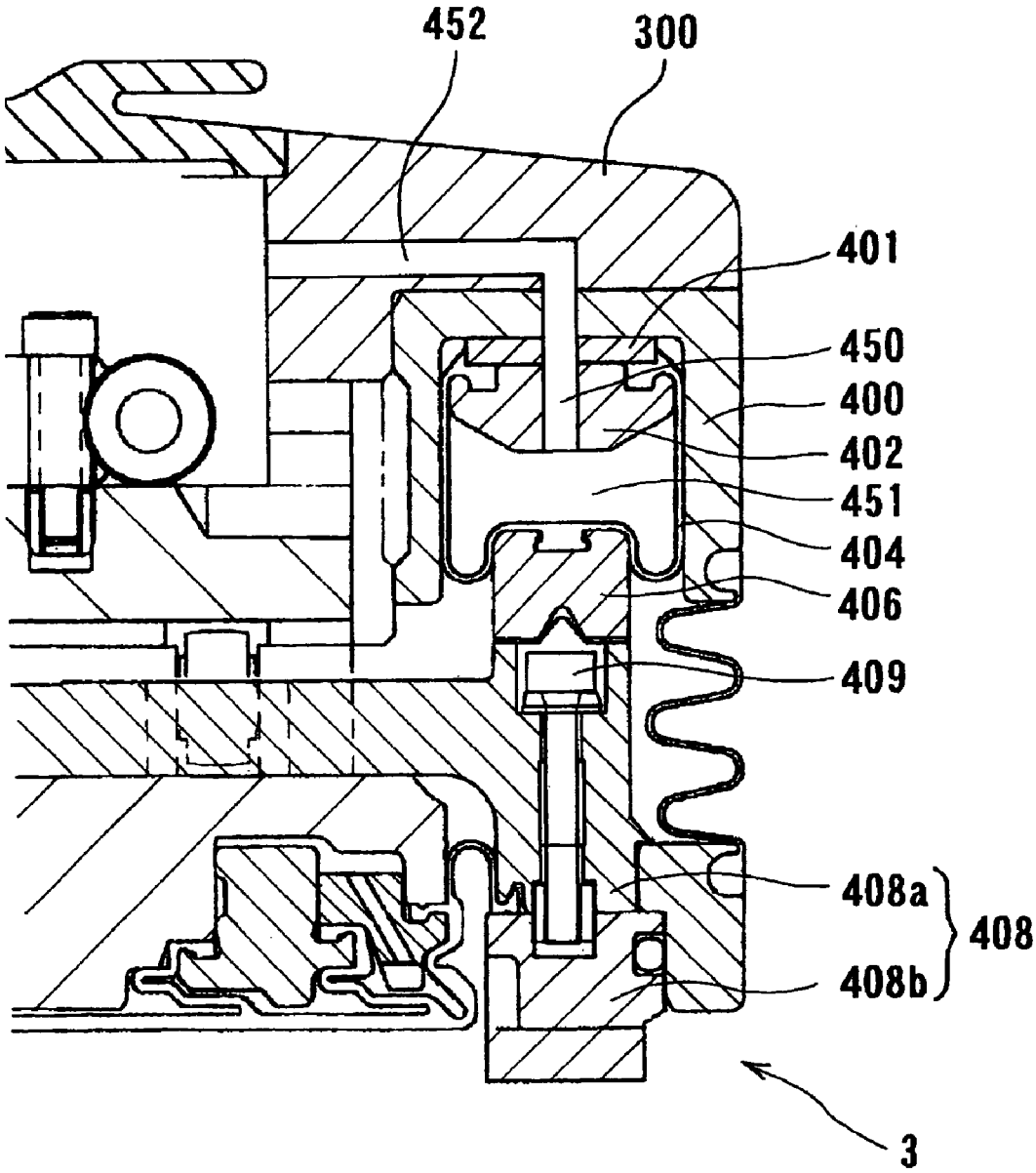
FIG. 7 is an enlarged view of VII part of FIG. 5.

FIG. 7 is an enlarged view of VII part of FIG. 5. As shown in FIG. 7, the upper ring member 408*a* and the lower ring member 408*b* are coupled by a plurality of bolts 409. The upper ring member 408*a* is composed of a metal such as SUS or a material such as ceramics, and the lower ring member 408*b* is composed of a resin material such as PEEK or PPS.

As shown in FIG. 7, the holder 402 has a passage 450 communicating with a chamber 451 formed by the elastic membrane 404. The upper member 300 has a passage 452 communicating with the passage 450 of the holder 402. The passage 450 of the holder 402 is connected via the passage 452 of the upper member 300 to a fluid supply source (not shown). Thus, a pressurized fluid is supplied through these passages to the chamber 451. Accordingly, by adjusting a pressure of the fluid to be supplied to the chamber 451, the elastic membrane 404 can be expanded and contracted so as to vertically move the piston 406. Thus, the ring member 408 of the retainer ring 3 can be pressed against the polishing pad 101 under a desired pressure.

In the illustrated example shown in FIGS. 2 through 7, the elastic membrane 404 employs a rolling diaphragm formed by an elastic membrane having bent portions. When an inner pressure in a chamber defined by the rolling diaphragm is changed, the bent portions of the rolling diaphragm are rolled so as to widen the chamber. The diaphragm is not brought into sliding contact with outside components and is hardly expanded and contracted when the chamber is widened. Accordingly, friction due to sliding contact can extremely be reduced, and a lifetime of the diaphragm can be prolonged. Further, pressing forces under which the retainer ring 3 presses the polishing pad 101 can accurately be adjusted.

With the above arrangement, the ring member 408 of the retainer ring 3 can be lowered. Accordingly, a pressing force of the retainer ring 3 can be maintained at a constant level by widening the space of the chamber 451 formed by the rolling diaphragm comprising an extremely low friction material even if the ring member 408 of the retainer ring 3 is worn out. Further, since the ring member 408, which is brought into contact with the polishing pad 101, and the cylinder 400 are connected by the deformable elastic membrane 404, no bending moment is produced by offset loads. Thus, surface pressures by the retainer ring 3 can be made uniform, and the retainer ring 3 becomes more likely to follow the polishing pad 101.

Figure 8:
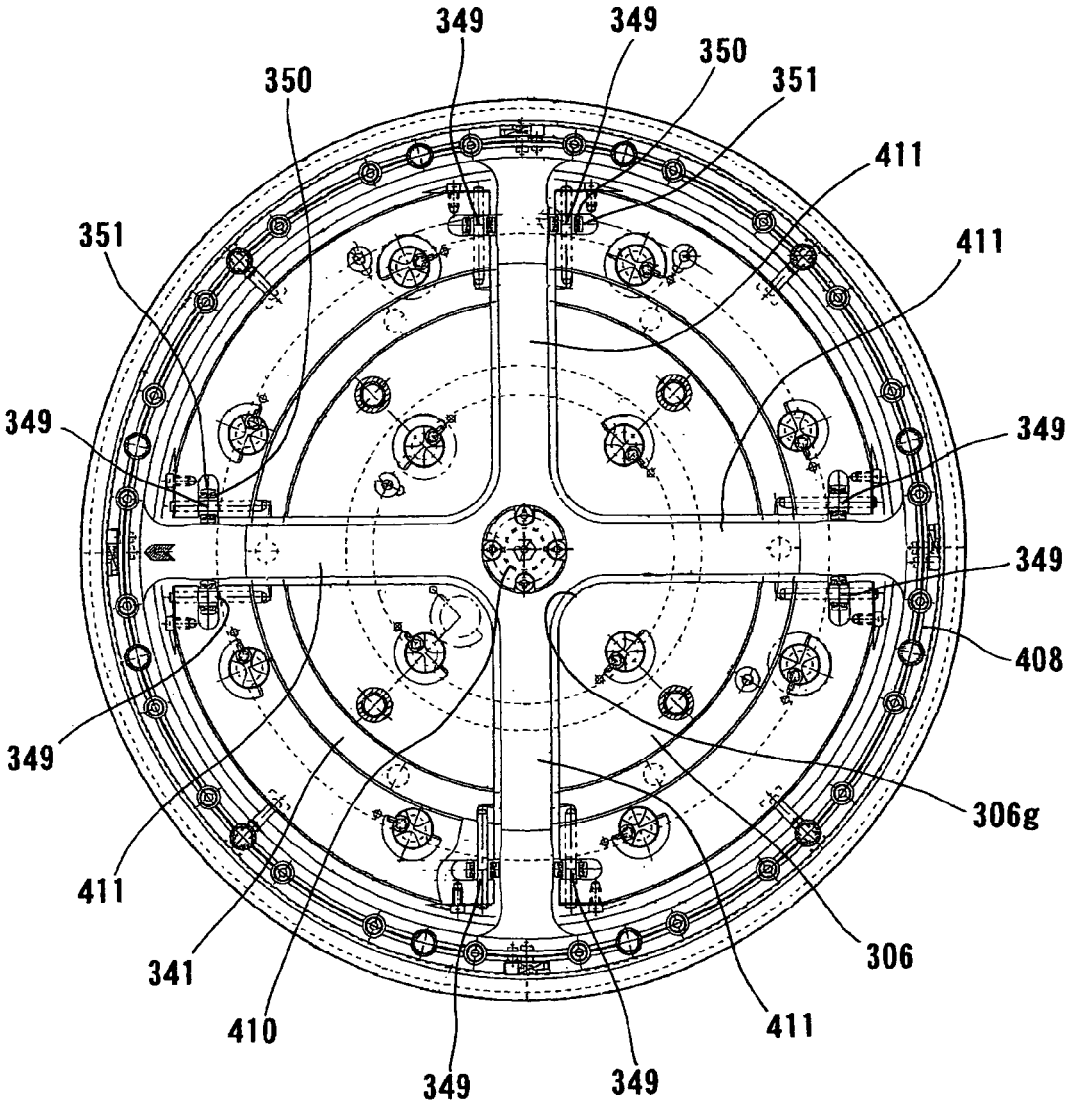
FIG. 8 is a view as viewed from line VIII-VIII of FIG. 2.

FIG. 8 is a view as viewed from line VIII-VIII of FIG. 2. As shown in FIG. 8, the ring member 408 disposed at the outer circumferential portion of the top ring body 2 is coupled to the shaft-like holding portion 410 disposed at the central portion of the top ring body 2 by the four connecting portions 411. The connecting portions 411 are housed in cross-shaped grooves 306*g* formed in the lower member 306 of the top ring body 2. As described above, the retainer ring 3 having the ring member 408, the shaft-like holding portion 410 and the connecting portions 411 is tiltable and vertically movable to follow undulation of the polishing surface 101*a* of the polishing table 100. A plurality of pairs of driving pins 349, 349 are provided in the lower member 306, and each pair of the driving pins 349, 349 is disposed so as to hold each connecting portion 411 therebetween. In this manner, since each pair of the driving pins 349, 349 is arranged to hold each connecting portion 411 therebetween, the rotation of the top ring body 2 is transmitted from the lower member 306 through the pairs of the driving pins 349, 349 to the connecting portions 411 to rotate the top ring body 2 and the retainer ring 3 integrally. A rubber cushion 350 is provided on the outer circumferential surface of the driving pin 349, and a collar 351 made of a low friction material such as PTFE or PEEK•PPS is provided on the rubber cushion 350. Further, mirror processing is applied to the outer surface of the connecting portion 411 to improve surface roughness of the outer surface of the connecting portion 411 with which the collar 351 made of a low friction material is bought into sliding contact.

According to the present embodiment, the collar 351 made of the low friction material is provided on the driving pin 349, and mirror processing is applied to the outer surface of the connecting portion 411 with which the collar 351 is brought into sliding contact, thus enhancing the sliding characteristics between the driving pin 349 and the connecting portion 411. Therefore, the following capability of the ring member 408 with respect to the polishing surface can be remarkably enhanced, and a desired surface pressure of the retainer ring can be applied to the polishing surface. Mirror processing may be applied to the driving pin 349, and a low friction material may be provided on the outer surface of the connecting portion 411 with which the driving pin 349 is engaged.

Since the rotary drive unit comprising the driving pins 349 and the connecting portions 411 for transmitting a rotative force from the top ring body 2 to the retainer ring 3 is provided within the top ring body 2, powder generated from the rotary drive unit can be contained within the top ring body 2. Thus, the powder is prevented from falling down onto the polishing surface, and defect such as scratch on the semiconductor wafer caused by powder can be remarkably reduced.

Figure 9:
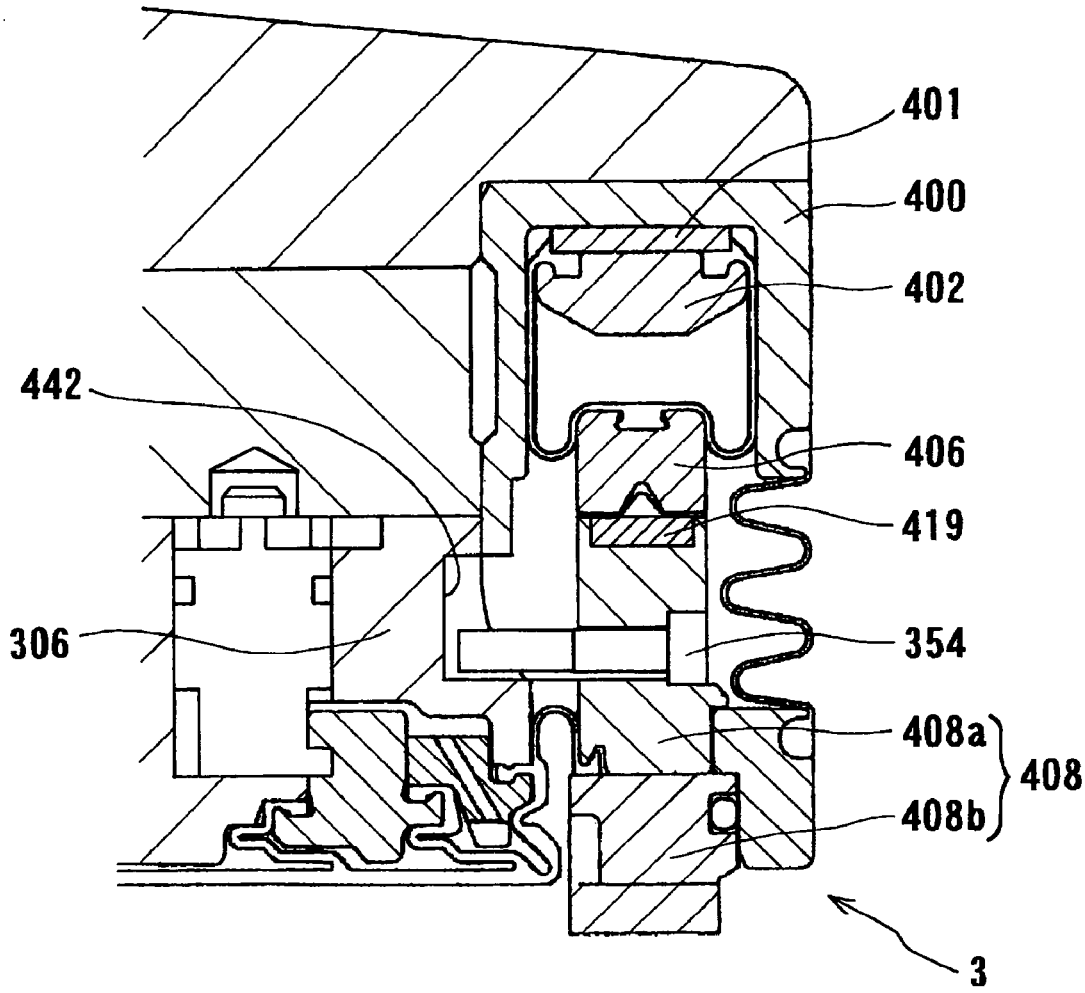
FIG. 9 is an enlarged view of IX part of FIG. 3.

FIG. 9 is an enlarged view of IX part of FIG. 3. As shown in FIG. 9, a magnet 419 is provided in the ring member 408 at the surface of the ring member 408 which is brought into contact with the piston 406. The piston 406 is composed of magnetic material, and surface processing such as coating or plating is applied to the piston 406 for corrosion protection. The piston 406 may be composed of magnetic stainless steel having corrosion resistance. Thus, the piston 406 composed of magnetic material and the ring member 408 having the magnet 419 are fixed to each other by a magnetic force of the magnet 419 provided in the ring member 408.

Since the piston 406 and the ring member 408 are fixed to each other by the magnetic force, even if the retainer ring 3 is vibrated during polishing, the piston 406 and the ring member 408 are prevented from being separated from each other, and the retainer ring 3 can be prevented from moving upward accidentally. Therefore, a surface pressure of the retainer ring 3 can be stabilized, and the possibility of removal of the semiconductor wafer from the top ring 1 due to slipping-off can be reduced.

A carrier assembly having the ring member 408 is frequently removed from the polishing apparatus for maintenance, but the piston 406 has a little chance for maintenance. In the case where the piston 406 and the ring member 408 are fixed to each other by a magnetic force, the ring member 408 which is removed frequently and the piston 406 which is removed less frequently can be separated easily.

As shown in FIG. 9, substantially oblong grooves 442 extending vertically are formed in the outer circumferential surface of the lower member 306 of the top ring body 2. The oblong grooves 442 are formed at equal intervals in the outer circumferential surface of the lower member 306 of the top ring body 2 (see FIG. 3). Stoppers 354 are provided in the upper ring member 408*a* of the retainer ring 3 so as to project radially inwardly. The stoppers 354 are configured to be engageable with the upper ends or lower ends of the oblong grooves 442 of the lower member 306, respectively.

Thus, the upper position or lower position of the retainer ring 3 with respect to the top ring body 2 is limited. Specifically, when the stopper 354 is engaged with the upper end of the oblong groove 442 of the lower member 306, the retainer ring 3 is located at the uppermost position with respect to the top ring body 2. When the stopper 354 is engaged with the lower end of the oblong groove 442 of the lower member 306, the retainer ring 3 is located at the lowermost position with respect to the top ring body 2.

According to the present embodiment, the top ring 1 has a detaching mechanism for detaching the ring member 408 from the piston 406. As shown in FIGS. 2 and 6, a plurality of cam lifters 432 which are rotatable about shafts 430 are provided on the ring member 408.

Figure 10B:
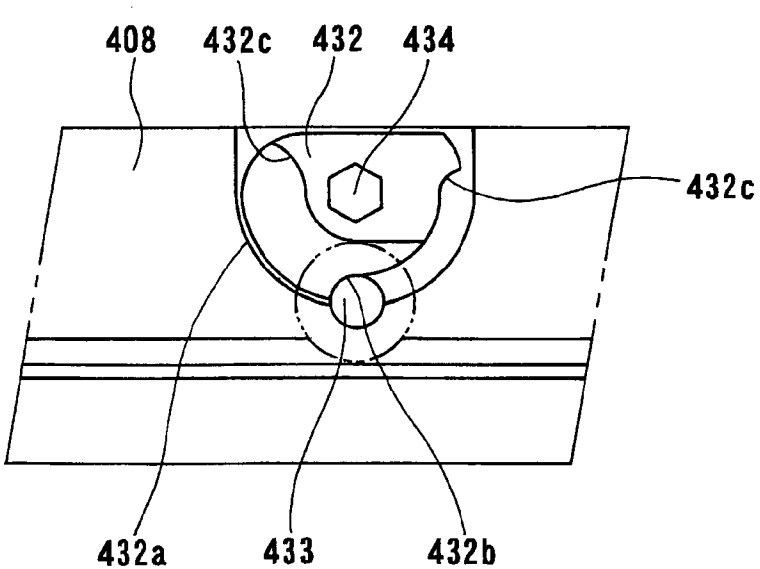
FIGS. 10A and 10B are views as viewed from an arrow X of FIG. 6.
Figure 10A:
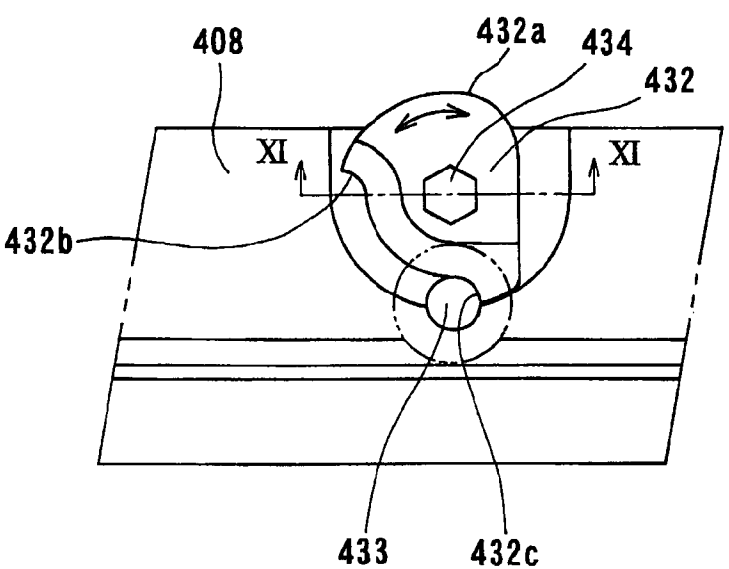

FIGS. 10A and 10B are views as viewed from an arrow X of FIG. 6. FIG. 10A shows the state in which the cam lifter 432 is operated, and FIG. 10B shows the state in which the cam lifter 432 is not operated. As shown in FIG. 10A and FIG. 10B, the outer circumferential surface of the cam lifter 432 constitutes a cam surface, and the cam surface has a profile whose radius from an axis of the shaft 430 (see FIG. 6) varies. Thus, by rotating the cam lifter 432, a portion 432*a* having the largest radius pushes up the piston 406. A wrench hole 434 for inserting a wrench is formed at the axis portion of the shaft 430 of the cam lifter 432.

As shown in FIG. 10A, an upper circular arc surface 432*b* is formed at the upper part of the cam lifter 432, and a lower circular arc surface 432*c* is formed at the lower part of the cam lifter 432. As shown in FIG. 6, a screw 433 is provided immediately below the cam lifter 432. As shown in FIG. 10A, the cam lifter 432 is rotatable in a clockwise direction or counterclockwise direction. The upper circular arc surface 432*b* or the lower circular arc surface 432*c* is engageable with the screw 433 to limit the rotation of the cam lifter 432 within a predetermined range (about 90°). As shown in FIG. 10A, when the lower circular arc surface 432*c* is engaged with the screw 433, the rotation of the cam lifter 432 in the clockwise direction is limited. As shown in FIG. 10B, when the upper circular arc surface 432*b* is engaged with the screw 433, the rotation of the cam lifter 432 in the counterclockwise direction is limited. Specifically, the upper circular arc surface 432*b*, the lower circular arc surface 432*c* of the cam lifter 432 and the screw 433 serve as a rotation limiting mechanism for limiting the rotation of the cam lifter 432 in the clockwise and counterclockwise directions within the predetermined range (about 90°).

Figure 11:
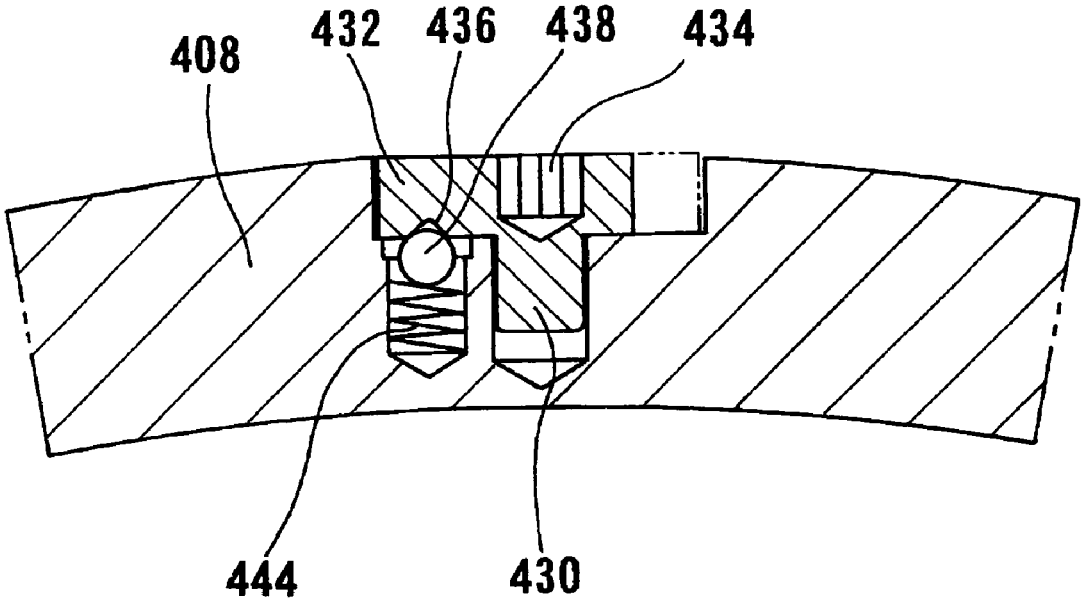
FIG. 11 is a cross-sectional view taken along line XI-XI of FIG. 10A.

FIG. 11 is a cross-sectional view taken along line XI-XI of FIG. 10A. As shown in FIG. 11, two recesses 436 are formed at about 90° apart locations in the backside surface of the cam lifter 432 (only one recess 436 is shown in FIG. 11). A ball 438 is provided in the ring member 408 in such a manner that the ball 438 is pressed against the backside surface of the cam lifter 432 by a helical compression spring 444. In this manner, when the ball 438 is fitted into the recess 436 of the cam lifter 432, the position of the cam lifter 432 is fixed.

At the time of maintenance of the carrier assembly, a wrench is inserted into the wrench hole 434, and the cam lifter 432 is rotated to form a clearance forcibly between the piston 406 and the ring member 408 by the cam surface of the outer circumferential surface of the cam lifter 432. Thus, a fastening force caused by a magnetic force between the piston 406 and the magnet 419 can be weakened, and the ring member 408 can be easily separated from the piston 406. When the ring member 408 is separated from the piston 406, as shown in FIG. 10A, the rotation of the cam lifter 432 is stopped by engagement of the lower circular arc surface 432*c* of the cam lifter 432 with the screw 433. At this time, the ball 438 is fitted into one of the recesses 436 of the cam lifter 432 (see FIG. 11), and the cam lifter 432 is fixed. Further, when the ring member 408 is fixed to the piston 406, a wrench is inserted into the wrench hole 434, and the cam lifter 432 is rotated. At this time, as shown in FIG. 10B, the rotation of the cam lifter 432 is stopped by engagement of the upper circular arc surface 432*b* of the cam lifter 432 with the screw 433. Then, the ball 438 is fitted into the other of the recesses 436 of the cam lifter 432, and the cam lifter 432 is fixed.

When the ring member 408 is separated from the piston 406, the main bolts 310 shown in FIG. 3 are removed, and the lower member 306 having the elastic membrane 314 and the retainer ring 3 having the ring member 408, the shaft-like holding portion 410 and the connecting portions 411 are separated from the intermediate member 304. In this manner, since the lower member 306 having the elastic membrane 314 together with the retainer ring 3 can be separated, maintenance of the lower ring member 408*b* of the retainer ring 3 and maintenance of the elastic membrane 314 can be easily performed.

In the example shown in FIGS. 9 through 11, the piston 406 is composed of magnetic material, and the magnet 419 is provided in the ring member 408. However, the ring member 408 may be composed of magnetic material, and a magnet may be provided in the piston 406. Further, in the example shown in FIGS. 9 through 11, the cam lifter 432 is provided on the ring member 408. However, the cam lifter 432 may be provided on the piston 406.

The retainer ring 3 will be further described with reference to FIG. 6. As shown in FIG. 6, a metal ring 440 made of SUS or the like is fitted over the lower ring member 408*b*. Since the metal ring 440 made of SUS or the like is fitted over the lower ring member 408*b*, the lower ring member 408*b* has an improved rigidity. Thus, even if a temperature of the ring member 408 increases due to the sliding contact between the ring member 408 and the polishing surface 101*a*, thermal deformation of the lower ring member 408*b* can be suppressed.

Further, as shown in FIG. 6, an O-ring 441 is interposed between the outer circumferential surface of the lower ring member 408*b* and the metal ring 440, and a connection sheet 420 is provided between the metal ring 440 and the cylinder 400. With the use of these members, especially with the use of a connection sheet 420, a foreign matter such as powder generated during polishing, can be prevented from falling down from the interior of the polishing head (top ring) onto the polishing surface effectively, and a polishing liquid (slurry) can be prevented from being introduce into the polishing head from the outside. A connection sheet 420 is ring shaped, and may comprise a resilient sheet having a bellows.

As shown in FIGS. 2 through 6, the elastic membrane 314 includes a seal portion 422 for connecting the elastic membrane 314 to the retainer ring 3 at an edge (periphery) 314*d* of the elastic membrane 314. The seal portion 422 has an upwardly curved shape. The seal portion 422 is disposed so as to fill a gap between the elastic membrane 314 and the ring member 408. The seal portion 422 is made of a deformable material. The seal portion 422 serves to prevent a foreign matter from falling down from the interior of the polishing head (top ring) onto the polishing surface and to prevent a polishing liquid from being introduced into the gap between the elastic membrane 314 and the ring member 408 while allowing the top ring body 2 and the retainer ring 3 to be moved relative to each other. In the present embodiment, the seal portion 422 is formed integrally with the edge 314*d* of the elastic membrane 314 and has a U-shaped cross-section.

If the connection sheet 420 and the seal portion 422 are not provided, a polishing liquid may be introduced into the interior of the top ring 1 so as to inhibit normal operation of the top ring body 2 and the retainer ring 3 of the top ring 1. In the present embodiment, the connection sheet 420 and the seal portion 422 prevent a polishing liquid from being introduced into the interior of the top ring 1. Accordingly, it is possible to operate the top ring 1 normally. The elastic membrane 404, the connection sheet 420, and the seal portion 422 are made of a highly strong and durable rubber material such as ethylene propylene rubber (EPDM), polyurethane rubber, silicone rubber, or the like.

In the top ring 1 according to the present embodiment, pressing forces to press a semiconductor wafer against a polishing surface are controlled by pressures of fluid to be supplied to the central chamber 360, the ripple chamber 361, the outer chamber 362, and the edge chamber 363 formed by the elastic membrane 314. Accordingly, the lower member 306 should be located away upward from the polishing pad 101 during polishing.

In the illustrated example, since the retainer ring 3 can vertically be moved independently of the lower member 306, a constant distance can be maintained between the semiconductor wafer and the lower member 306 even if the ring member 408 of the retainer ring 3 is worn out. Accordingly, profiles of polished semiconductor wafers can be stabilized.

In the illustrated example, the elastic membrane 314 is disposed so as to be brought into contact with substantially the entire surface of the semiconductor wafer. However, the elastic membrane 314 may be brought into contact with at least a portion of a semiconductor wafer.

Figure 12:
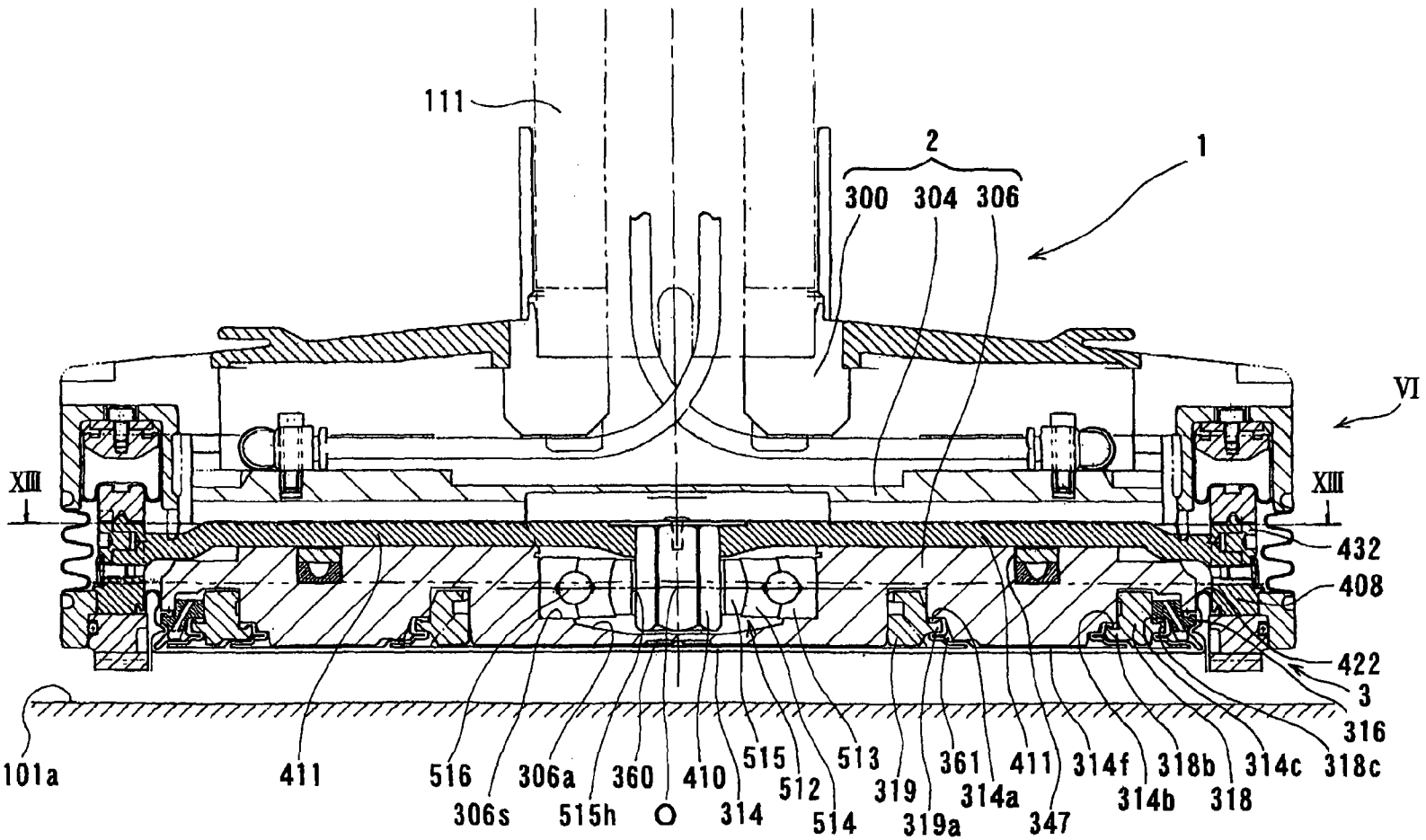
FIG. 12 is a cross-sectional view showing a top ring constituting a polishing head according to a second aspect of the present invention.
Figure 13:
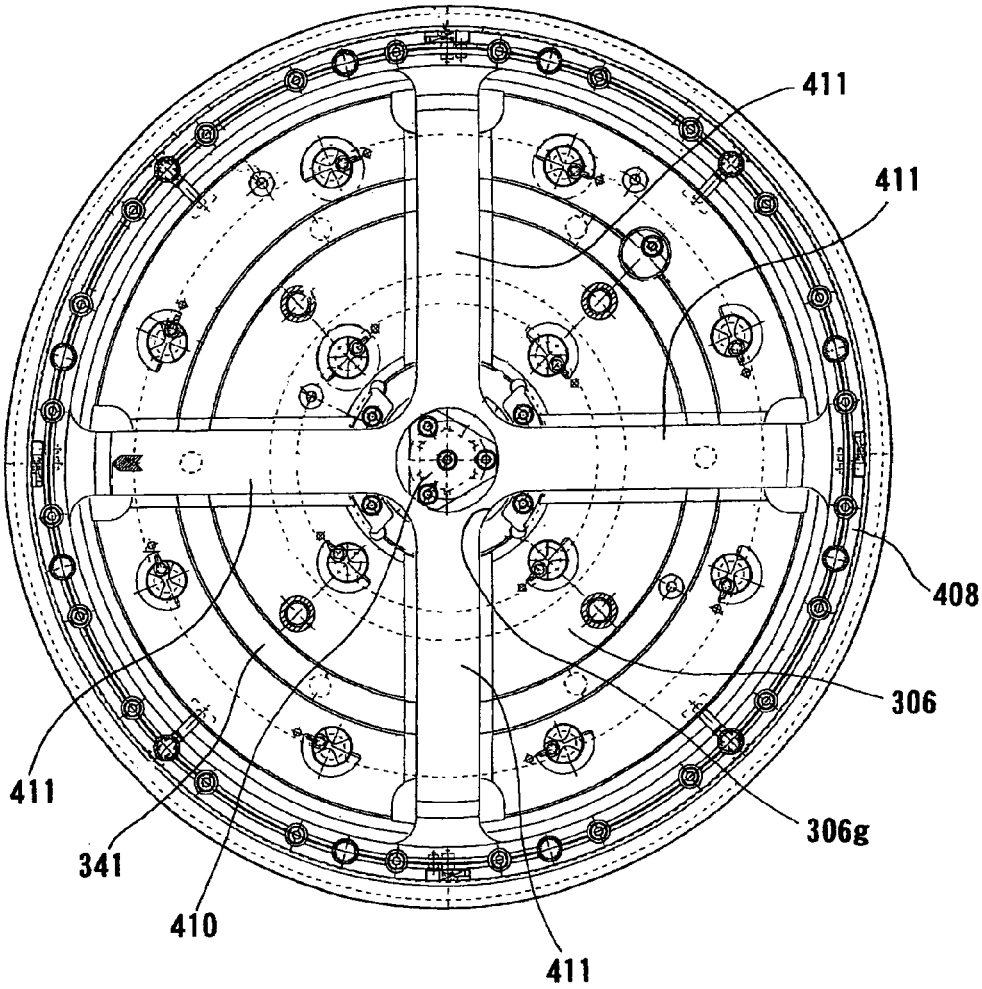
FIG. 13 is a view as viewed from line XIII-XIII of FIG. 12.

Next, a polishing head of a polishing apparatus according to a second aspect of the present invention will be described below with reference to FIG. 12 through 17. FIG. 12 is a cross-sectional view showing a top ring constituting a polishing head according to a second aspect of the present invention. FIG. 13 is a view as viewed from line XIII-XIII of FIG. 12. In the polishing head according to the second aspect of the present invention, a gyro mechanism is used as a bearing mechanism for supporting the shaft-like holding portion 410 of the retainer ring 3. As shown in FIGS. 12 and 13, in the polishing head according to the second aspect of the preset invention, as in the polishing head according to the first aspect of the present invention, the retainer ring 3 comprises a ring member 408 disposed at an outer peripheral portion of the top ring body 2 and configured to hold a peripheral edge of the semiconductor wafer, a shaft-like holding portion 410 disposed at a radially central portion of the top ring body 2 and configured to hold the ring member 408, and connecting portions 411 for connecting the ring member 408 and the shaft-like holding portion 410. The shaft-like holding portion 410 of the retainer ring 3 is supported by the lower member 306 through a support mechanism 512 comprising a gyro mechanism. The support mechanism 512 comprises an outer ring 513 fitted in the recess 306*a* of the lower member 306 and fixed to the lower member 306, an intermediate ring 514 supported by the outer ring 513, and an inner ring 515 supported by the intermediate ring 514. The inner circumferential surface of the outer ring 513 and the outer circumferential surface of the intermediate ring 514 are formed into spherical surfaces whose center is a fulcrum O, and are brought into sliding contact with each other. The inner circumferential surface of the intermediate ring 514 and the outer circumferential surface of the inner ring 515 are formed into spherical surfaces whose center is the fulcrum O, and are brought into sliding contact with each other.

Figure 14:
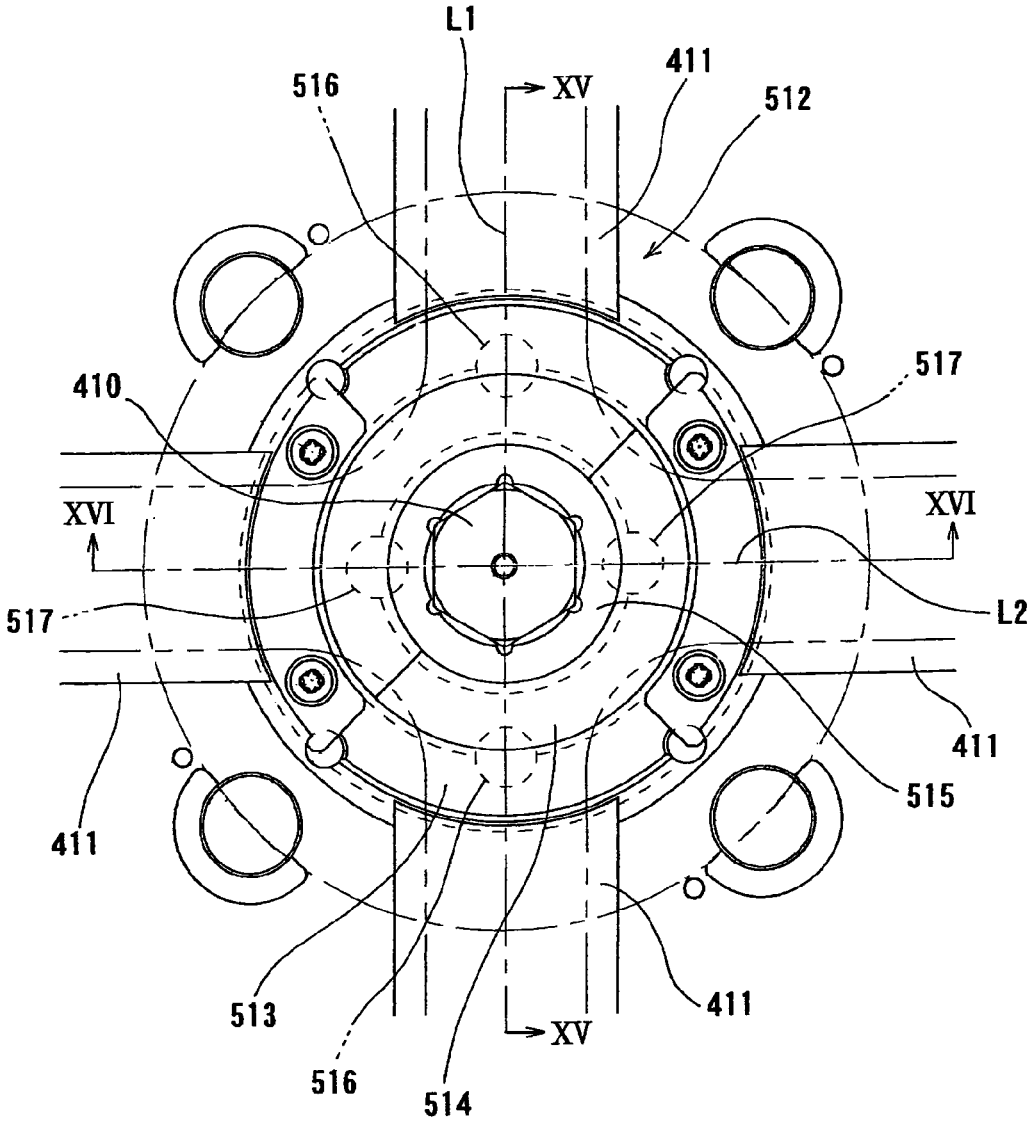
FIG. 14 is a plan view showing a support mechanism and part of the retainer ring.
Figure 15:
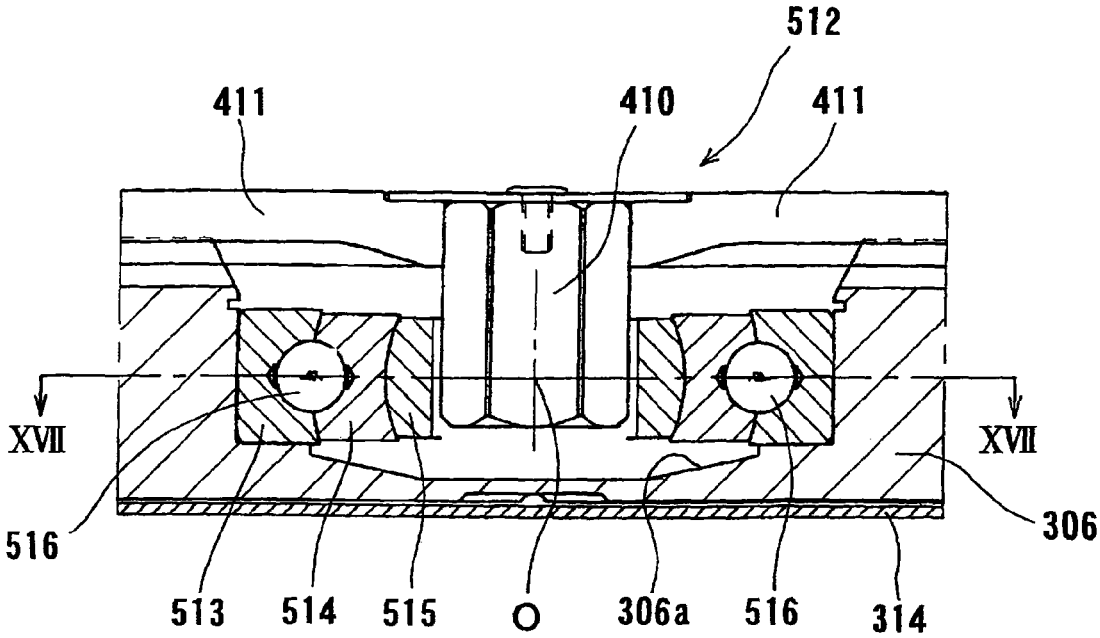
FIG. 15 is a cross-sectional view taken along line XV-XV of FIG. 14.
Figure 16:
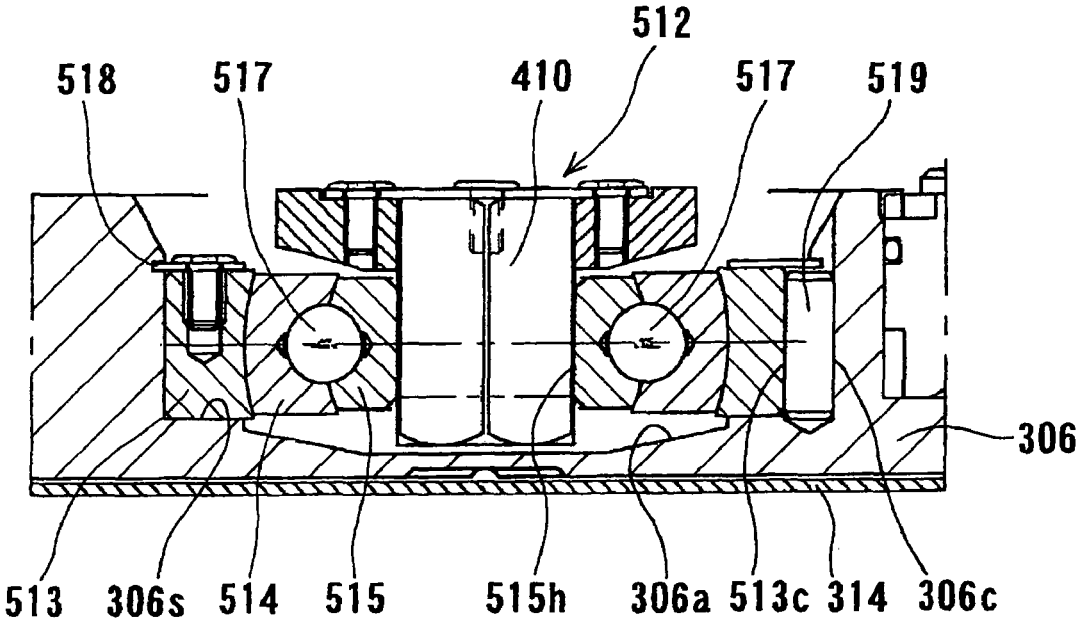
FIG. 16 is a cross-sectional view taken along line XVI-XVI of FIG. 14.
Figure 17:
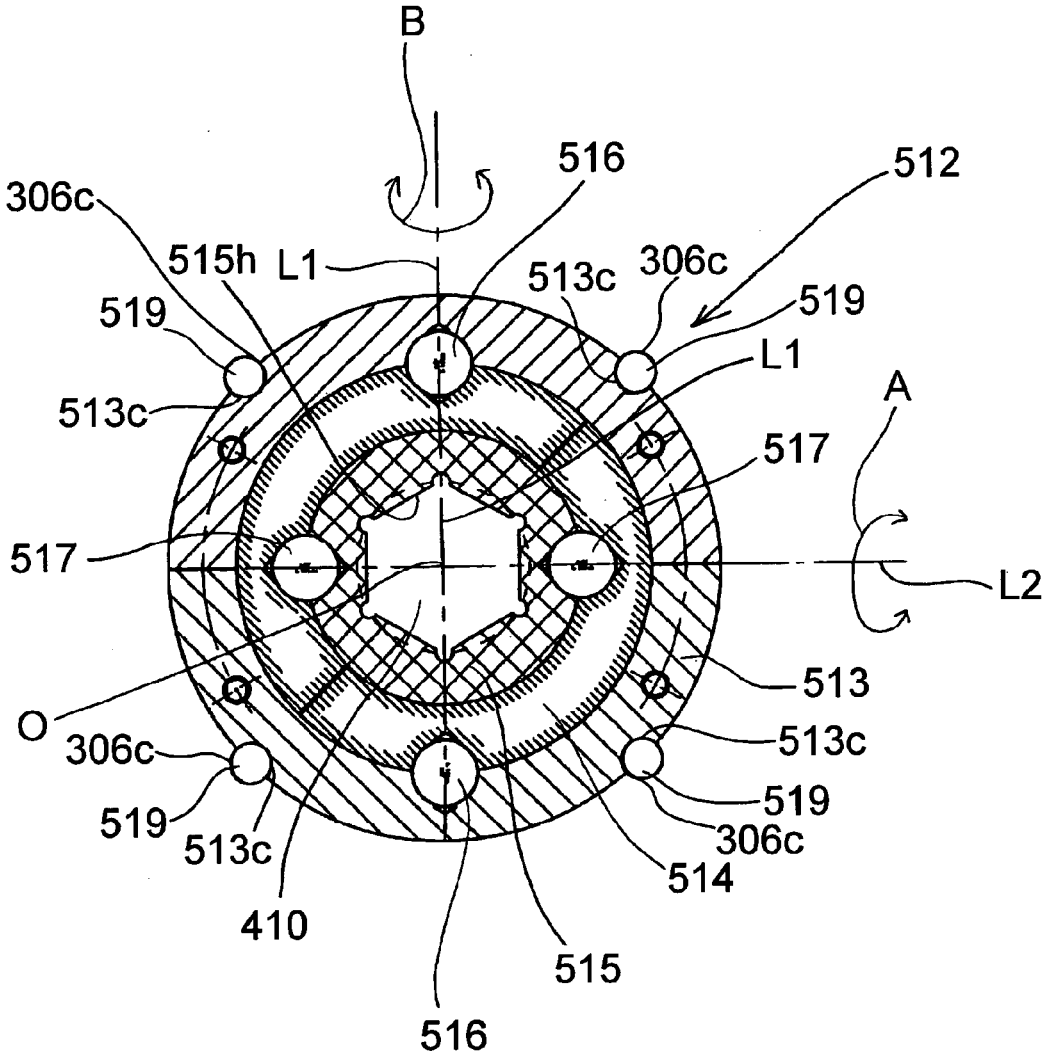
FIG. 17 is a cross-sectional view taken along line XVII-XVII of FIG. 15.

FIGS. 14 through 17 are views showing the detailed structure of the support mechanism 512. FIG. 14 is a plan view showing the support mechanism 512 and part of the retainer ring 3. FIG. 15 is a cross-sectional view taken along line XV-XV of FIG. 14. FIG. 16 is a cross-sectional view taken along line XVI-XVI of FIG. 14. FIG. 17 is a cross-sectional view taken along line XVII-XVII of FIG. 15. As shown in FIGS. 14 through 17, two balls 516, 516 are interposed between the inner circumferential surface of the outer ring 513 and the outer circumferential surface of the intermediate ring 514, and two balls 517, 517 are interposed between the inner circumferential surface of the intermediate ring 514 and the outer circumferential surface of the inner ring 515.

In the support mechanism 512 shown in FIGS. 14 through 17, the intermediate ring 514 is rotatable with respect to the outer ring 513 about an horizontal axis L1 connecting the two balls 516 and 516. Further, the inner ring 515 is rotatable with respect to the intermediate ring 514 about an horizontal axis L2 connecting the two balls 517 and 517. The shaft-like holding portion 410 of the retainer ring 3 has a hexagonal cross-section, and is vertically movably fitted in a hexagonal through-hole 515*h* of the inner ring 515. As shown in FIG. 16, the outer ring 513 is fixed to the lower member 306 in such a manner that the lower end of the outer ring 513 is brought into contact with a step 306*s* of the recess 306*a* of the lower member 306 and the upper end of the outer ring 513 is engaged with clips 518.

With the above arrangement, when the shaft-like holding portion 410 together with the ring member 408 is tilted, the shaft-like holding portion 410 and the inner ring 515 are integrally rotated about the axis L2 as shown by an arrow A (see FIG. 17), and the shaft-like holding portion 410, the inner ring 515 and the intermediate 514 are integrally rotated about the axis L1 as shown by an arrow B (see FIG. 17). Specifically, the inner ring 515 together with the shaft-like holding portion 410 is rotatable about the two orthogonal horizontal axes L1 and L2. As a result, the shaft-like holding portion 410 and the inner ring 515 are rotatable (tiltable) in all directions (360°) about the fulcrum O which is an intersection point of the axes L1 and L2. That is, the fulcrum O is the center of the rotation of the shaft-like holding portion 410 and the inner ring 515.

In the retainer ring 3 constructed as shown in FIGS. 12 through 17, the retainer ring 3 is tiltable with respect to the horizontal plane to follow undulation of the polishing surface 101*a* of the polishing table 100. Specifically, the ring member 408 is tilted with respect to the horizontal plane to follow undulation of the polishing surface 101*a*, and the shaft-like holding portion 410 is tilted integrally with the ring member 408. At this time, the tilting of the ring member 408 and the shaft-like holding portion 410 is allowed by the support mechanism 512 comprising the gyro mechanism. In other words, the ring member 408 and the shaft-like holding portion 410 are tiltable by the rotation of the inner ring 515 with respect to the outer ring 513 about the fulcrum O in all directions (360°). Specifically, the retainer ring 3 including the ring member 408 is tiltable about the fulcrum O located at the central portion of the top ring body 2 by the support mechanism 512 comprising the gyro mechanism. Further, the retainer ring 3 is vertically moved to follow undulation of the polishing surface 101*a* of the polishing table 100, simultaneously with the tilting motion. That is, the ring member 408 is vertically moved to follow undulation of the polishing surface 101*a*, and the shaft-like holding portion 410 is vertically moved integrally with the ring member 408. The vertical motion of the shaft-like holding portion 410 is guided by the through-hole 515*h* of the inner ring 515. A lateral force (horizontal force) is applied to the retainer ring 3 by a frictional force between the semiconductor wafer and the polishing surface 101*a* of the polishing table 100 during polishing of the semiconductor wafer. This lateral force can be received by the fulcrum O located above the central portion of the semiconductor wafer.

As shown in FIGS. 16 and 17, a plurality of circular arc notches 513*c* are formed in the outer circumferential surface of the outer ring 513, and a plurality of circular arc notches 306*c* are formed in the inner circumferential surface of the lower member 306. Pins 519 are inserted into the cylindrical grooves each comprising the circular arc notch 513*c* and the circular arc notch 306*c*. With this arrangement, the rotation of the top ring body 2 is transmitted to the outer ring 513 through the pins 519, and is then transmitted through the balls 516, the intermediate ring 514, and the balls 517 to the inner ring 515. In the present embodiment, the shaft-like holding portion 410 of the retainer ring 3 is formed into a shaft-like member having a hexagonal cross-section, and the shaft-like holding portion 410 having the hexagonal cross-section is housed in the hexagonal through-hole 515*h* of the inner ring 515. Further, since the inner ring 515 is rotatable only about the two orthogonal horizontal axes L1 and L2, the rotation of the top ring body 2 is transmitted through the hexagonal through-hole 515*h* of the inner ring 515 to the shaft-like holding portion 410 having the hexagonal cross-section, and hence the retainer ring 3 is rotated integrally with the top ring body 2. Accordingly, in the present embodiment, the driving pins 349 for rotating the retainer ring 3 integrally with the top ring body 2 used in the first aspect can be eliminated. The sliding contact surfaces of the support mechanism 512 are provided with a low friction material in the same manner as the support mechanism 412 of the first aspect.

Figure 18:
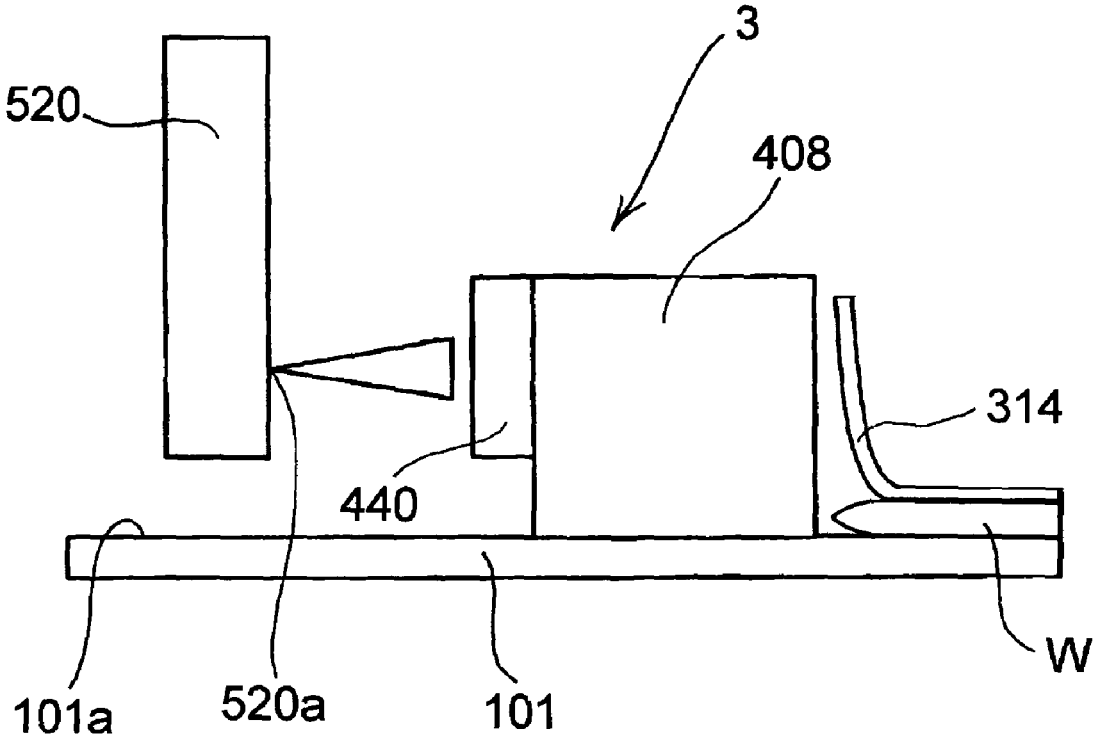
FIG. 18 is a schematic cross-sectional view showing part of a polishing apparatus.
Figure 19:
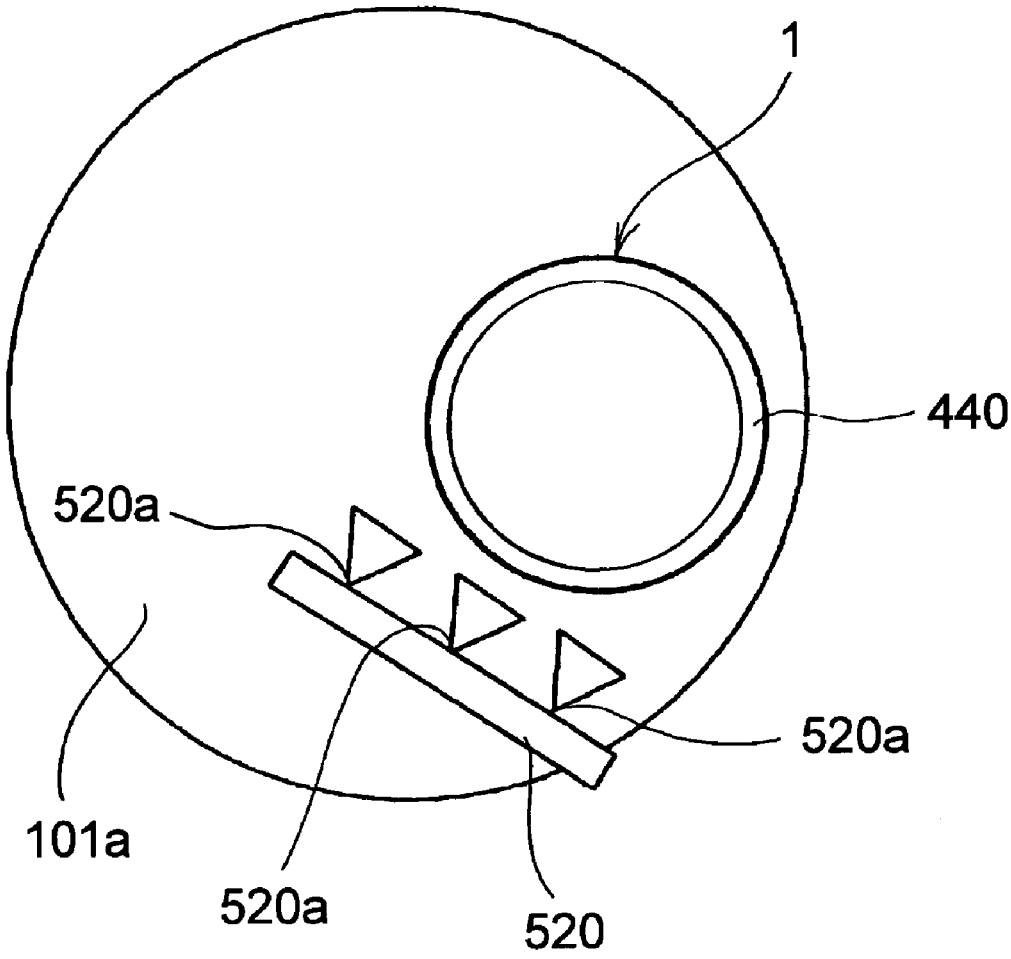
FIG. 19 is a schematic plan view showing the polishing apparatus.

FIGS. 18 and 19 are views showing a polishing apparatus having a cooling apparatus for cooling the retainer ring 3 according to the present invention. FIG. 18 is a schematic cross-sectional view showing part of a polishing apparatus, and FIG. 19 is a schematic plan view showing the polishing apparatus. As shown in FIGS. 18 and 19, a metal ring 440 composed of SUS or the like is fitted over the ring member 408 of the retainer ring 3. A nozzle block 520 is disposed adjacent to the top ring 1. The nozzle block 520 has a plurality of nozzles 520*a*, and a pressurized gas such as compressed air or nitrogen gas or a pressurized fluid such as mist is supplied from a fluid supply source to the nozzle block 520. The temperature of the ring member 408 increases by friction heat between the ring member 408 and the polishing surface. A pressurized fluid is blown from the nozzles 520*a* onto the outer circumferential surface of the metal ring 440 by supplying the pressurized fluid from the fluid supply source to the nozzle block 520. Therefore, the ring member 408 is cooled, and the temperature of the ring member 408 can be prevented from increasing to suppress thermal expansion of the ring member 408. Thus, the effect of correcting the configuration of the pad surface of the polishing pad 101 by the ring member 408 can last long.

Although certain preferred embodiments of the present invention have been shown and described in detail, it should be understood that various changes and modifications may be made therein without departing from the scope of the appended claims.

INDUSTRIAL APPLICABILITY

The present invention is applicable to a polishing apparatus for polishing an object to be polished (substrate) such as a semiconductor wafer to a flat mirror finish. The polishing apparatus is used in a semiconductor device fabrication process.

The invention claimed is:

1. An apparatus for polishing a substrate, comprising:

a polishing table having a polishing surface;

a top ring body having a pressure chamber for being supplied with a pressurized fluid and configured to press the substrate against said polishing surface under a fluid pressure when said pressure chamber is supplied with the pressurized fluid; and a retainer ring provided at an outer peripheral portion of said top ring body and configured to be movable independently of said top ring body and to press said polishing surface;

wherein a fulcrum for receiving a lateral force applied from the substrate to said retainer ring during polishing of the substrate is located above a central portion of the substrate.

2. The apparatus according to claim 1, wherein said retainer ring is tiltable about said fulcrum.

3. The apparatus according to claim 1, wherein said retainer ring is vertically movably supported on an axis passing through said fulcrum.

4. The apparatus according to claim 1, wherein said top ring body has at least one elastic membrane configured to form a plurality of pressure chambers for being supplied with a pressurized fluid; and wherein said fulcrum is located above said pressure chamber located at the central portion of the substrate.

5. The apparatus according to claim 1, wherein said fulcrum is located at a rotation center of a support mechanism for supporting said retainer ring by said top ring body.

6. An apparatus for polishing a substrate, comprising:

a polishing table having a polishing surface;

a top ring body having a pressure chamber for being supplied with a pressurized fluid and configured to press the substrate against said polishing surface under a fluid pressure when said pressure chamber is supplied with the pressurized fluid; and a retainer ring provided at an outer peripheral portion of said top ring body and configured to be movable independently of said top ring body and to press said polishing surface;

wherein a support mechanism for supporting said retainer ring tiltably to allow said retainer ring to follow movement of said polishing surface is located above a central portion of the substrate.

7. The apparatus according to claim 6, wherein said support mechanism supports said retainer ring vertically movably.

8. The apparatus according to claim 6, wherein said retainer ring is movable independently of said top ring body by said support mechanism.

9. The apparatus according to claim 6, wherein sliding contact surfaces of said support mechanism is composed of a low friction material.

10. The apparatus according to claim 6, wherein said retainer ring comprises a ring member configured to hold an peripheral edge of the substrate, a holding portion disposed at a central portion of said top ring body and configured to hold said ring member, and a connecting portion for connecting said ring member and said holding portion; and wherein said holding portion is supported by said support mechanism.

11. The apparatus according to claim 6, wherein said top ring body has at least one elastic membrane configured to form a plurality of pressure chambers for being supplied with a pressurized fluid; and wherein said support mechanism is located above said pressure chamber located at the central portion of the substrate.

12. The apparatus according to claim 6, wherein said support mechanism comprises a spherical bearing mechanism for supporting said retainer ring rotatably by a spherical surface.

13. The apparatus according to claim 6, wherein said support mechanism comprises a gyro mechanism for supporting said retainer ring rotatably about two orthogonal axes.

14. The apparatus according to claim 6, wherein a metal ring is mounted on said retainer ring.

15. The apparatus according to claim 6, further comprising a nozzle configured to supply a fluid for cooling said retainer ring.

16. The apparatus according to claim 6, further comprising a rotary drive unit provided in said top ring body and configured to transmit a rotative force from said top ring body to said retainer ring.

* * * * *